US010421282B2

(12) United States Patent
Moriyama et al.

(10) Patent No.: US 10,421,282 B2
(45) Date of Patent: Sep. 24, 2019

(54) LIQUID EJECTING APPARATUS WITH AN INK CONTAINER REMOTE FROM AN INK EJECTION SECTION

(71) Applicant: SEIKO EPSON CORPORATION, Tokyo (JP)

(72) Inventors: Ryuji Moriyama, Matsumoto (JP); Makoto Sato, Matsumoto (JP); Hisayuki Akahane, Matsumoto (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/793,789

(22) Filed: Oct. 25, 2017

(65) Prior Publication Data

US 2018/0126743 A1 May 10, 2018

(30) Foreign Application Priority Data

Nov. 4, 2016 (JP) ..... 2016-215981

(51) Int. Cl.
*B41J 2/17* (2006.01)
*B41J 2/175* (2006.01)
(Continued)

(52) U.S. Cl.
CPC ..... *B41J 2/1721* (2013.01); *B41J 2/1752* (2013.01); *B41J 2/17509* (2013.01); *B41J 2/17523* (2013.01); *B41J 2/185* (2013.01); *B41J 25/001* (2013.01); *B41J 29/02* (2013.01); *B41J 29/13* (2013.01); *B41J 2/04548* (2013.01);
(Continued)

(58) Field of Classification Search
CPC ..... B41J 2/1721; B41J 2/17509; B41J 29/02; B41J 2/185; B41J 2/1752; B41J 29/13; B41J 2/17523; B41J 25/001; B41J 2002/1856; B41J 2002/14362; B41J 2/04548
See application file for complete search history.

(56) References Cited

U.S. PATENT DOCUMENTS

2002/0118242 A1* 8/2002 Tajima ..... B41J 2/17556 347/17
2014/0009550 A1 1/2014 Togo et al.
(Continued)

FOREIGN PATENT DOCUMENTS

JP 2012-061624 A 3/2012
JP 2012-076224 A 4/2012
(Continued)

*Primary Examiner* — Bradley W Thies
(74) *Attorney, Agent, or Firm* — Workman Nydegger

(57) ABSTRACT

A liquid ejecting apparatus includes a liquid ejecting section having a nozzle that is configured to eject liquid; a liquid container that is configured to accommodate the liquid ejected from the nozzle, and is disposed at a separate position from the liquid ejecting section; and a power supply section that supplies electric power at least required for liquid ejection from the liquid ejecting section, wherein at least part of the liquid container overlaps at least part of the power supply section in an apparatus depth direction. At least part of the liquid container overlaps at least part of the power supply section in an apparatus depth direction. The liquid container includes an introduction port that allows for liquid introduction.

11 Claims, 19 Drawing Sheets

(51) Int. Cl.

| | |
|---|---|
| ***B41J 25/00*** | (2006.01) |
| ***B41J 2/185*** | (2006.01) |
| ***B41J 29/02*** | (2006.01) |
| ***B41J 29/13*** | (2006.01) |
| ***B41J 2/045*** | (2006.01) |
| ***B41J 2/14*** | (2006.01) |

(52) U.S. Cl.
CPC ..... *B41J 2002/14362* (2013.01); *B41J 2002/1856* (2013.01)

(56) References Cited

U.S. PATENT DOCUMENTS

| | | | | |
|---|---|---|---|---|
| 2014/0104349 | A1* | 4/2014 | Kimura | B41J 2/17509 347/85 |
| 2015/0124028 | A1 | 5/2015 | Kimura et al. | |
| 2015/0283816 | A1 | 10/2015 | Kimura et al. | |
| 2015/0352853 | A1* | 12/2015 | Kudo | B41J 2/175 347/86 |
| 2016/0200111 | A1 | 7/2016 | Kimura et al. | |
| 2017/0246869 | A1* | 8/2017 | Shirota | B41J 2/16505 |
| 2018/0170064 | A1* | 6/2018 | Higuchi | B41J 2/01 |

FOREIGN PATENT DOCUMENTS

| | | | |
|---|---|---|---|
| JP | 2014-014943 | A | 1/2014 |
| JP | 2014-079908 | A | 5/2014 |

* cited by examiner

LIQUID EJECTING APPARATUS WITH AN INK CONTAINER REMOTE FROM AN INK EJECTION SECTION

BACKGROUND

1. Technical Field

The present invention relates to liquid ejecting apparatuses that eject liquid.

2. Related Art

An example of liquid ejecting apparatuses that eject liquid is an ink jet printer. Ink jet printers include a so-called serial type ink jet printer that is provided with a recording head as a liquid ejecting section that ejects ink, which is an example of liquid, as well as a carriage movable in a predetermined direction. Further, ink jet printers include a type in which an ink container that stores ink is mounted on a carriage, and a type in which an ink container is provided outside the carriage. In the type in which an ink container is provided outside the carriage, the ink container and the carriage (recording head) are connected to each other via an ink supply tube.

For example, JP-A-2014-79908 discloses a configuration in which an ink tank (ink container) is provided on the apparatus front side and the ink tank is covered by a cover. In this configuration, the ink tank is housed in a housing that forms the outer appearance of the entire apparatus so that the ink tank does not protrude from the apparatus side surface in favor of outer appearance design.

In the ink jet printer, a power supply section (regulator) that supplies electric power to a power source such as a motor is disposed. Since the power supply section requires a substantial installation space, it has a significant effect on the apparatus dimension. In the most conventional ink jet printers, which include an inlet for insertion and removal of a power supply plug is provided on the apparatus rear side and at a position close to the apparatus side surface, the power supply section is also provided at the same position. Accordingly, the conventional recording apparatuses are increased in size due to the positioning of the power supply section. Under these circumstances, providing an ink tank as well causes a further increase in the apparatus. From the above viewpoints, there is still room for improvement for the conventional ink jet printers.

SUMMARY

An advantage of some aspects of the invention is size reduction in the configuration having an ink container disposed outside a carriage is achieved.

A liquid ejecting apparatus according to a first aspect of the present invention includes a liquid ejecting section having a nozzle that is configured to eject liquid; a liquid container that is configured to accommodate the liquid ejected from the nozzle, and is disposed at a separate position from the liquid ejecting section; and a power supply section that supplies electric power at least required for liquid ejection from the liquid ejecting section, wherein at least part of the liquid container overlaps at least part of the power supply section in an apparatus depth direction.

With this configuration, at least part of the liquid container overlaps at least part of the power supply section in an apparatus depth direction. Accordingly, the entire occupation region of the liquid container and the entire occupation region of the power supply section do not superpose each other in the apparatus depth direction, thereby reducing the dimension in the apparatus depth direction.

In this aspect, the liquid ejecting apparatus further includes a liquid ejecting section having a nozzle that is configured to eject liquid; a liquid container that is configured to accommodate the liquid ejected from the nozzle, and is disposed at a separate position from the liquid ejecting section; and a power supply section that supplies electric power at least required for liquid ejection from the liquid ejecting section, wherein at least part of the liquid container overlaps at least part of the power supply section in an apparatus height direction.

With this configuration, at least part of the liquid container overlaps at least part of the power supply section in an apparatus height direction. Accordingly, the entire occupation region of the liquid container and the entire occupation region of the power supply section do not superpose each other in the apparatus height direction, thereby reducing the dimension in the apparatus height direction.

In this aspect, the liquid container has an introduction port that allows for liquid introduction. With this configuration, since the liquid container has the introduction port that allows for liquid introduction, the liquid container can be replenished with liquid in a simple operation.

In this aspect, the introduction port is located on a front side relative to the power supply section in the apparatus depth direction. With this configuration, in the configuration in which the introduction port is located on a front side relative to the power supply section in the apparatus depth direction, the same effect as that of the above configuration can be obtained.

In this aspect, the liquid ejecting apparatus further includes an operation panel that performs various operations on an apparatus front side, wherein the introduction port overlaps at least part of the operation panel in the apparatus depth direction.

With this configuration, since the introduction port overlaps at least part of the operation panel in the apparatus depth direction, liquid introduction from the introduction port can be performed in a simple operation.

In this aspect, the liquid ejecting apparatus further includes a buffer container that is connected to the liquid container so as to store liquid discharged from the liquid container, wherein at least part of the liquid container overlaps at least part of the buffer container in the apparatus width direction which is a direction perpendicular to the apparatus depth direction.

With this configuration, at least part of the liquid container overlaps at least part of the buffer container in the apparatus width direction which is a direction perpendicular to the apparatus depth direction. Accordingly, the entire occupation region of the liquid container and the entire occupation region of the buffer container do not superpose each other in the apparatus width direction, thereby reducing the dimension in the apparatus width direction.

In this aspect, the liquid ejecting apparatus further includes a buffer container that is connected to the liquid container so as to store liquid discharged from the liquid container, wherein at least part of the liquid container overlaps at least part of the buffer container in the apparatus depth direction.

With this configuration, at least part of the liquid container overlaps at least part of the buffer container in the apparatus depth direction. Accordingly, the entire occupation region of the liquid container and the entire occupation region of the buffer container do not superpose each other in the apparatus depth direction, thereby reducing the dimension in the apparatus depth direction.

In this aspect, the liquid ejecting apparatus further includes a waste liquid container that stores waste liquid ejected from the liquid ejecting section, wherein at least part of the liquid container overlaps at least part of the waste liquid container in the apparatus width direction which is a direction perpendicular to the apparatus depth direction.

With this configuration, at least part of the liquid container overlaps at least part of the waste liquid container in the apparatus width direction which is a direction perpendicular to the apparatus depth direction. Accordingly, the entire occupation region of the liquid container and the entire occupation region of the waste liquid container do not superpose each other in the apparatus width direction, thereby reducing the dimension in the apparatus width direction.

In this aspect, the liquid ejecting apparatus further includes a circuit substrate that constitutes a control means that performs control of the apparatus, wherein the liquid container is provided on a first end of the apparatus and the circuit substrate is provided on a second side of the apparatus in the apparatus width direction which is a direction perpendicular to the apparatus depth direction.

With this configuration, the liquid container is provided on a first end of the apparatus and the circuit substrate is provided on a second side of the apparatus in the apparatus width direction which is a direction perpendicular to the apparatus depth direction. Accordingly, ink does not almost attach to the circuit substrate even if it leaks out from the liquid container, thereby maintaining the performance of the circuit substrate.

In this aspect, the liquid ejecting apparatus further includes a circuit substrate that constitutes a control means that performs control of the apparatus, wherein the liquid container is provided on an apparatus front side, and the circuit substrate is provided on an apparatus rear side.

With this configuration, the liquid container is provided on an apparatus front side, and the circuit substrate is provided on an apparatus rear side in the apparatus depth direction. Accordingly, ink does not almost attach to the circuit substrate even if it leaks out from the liquid container, thereby maintaining the performance of the circuit substrate.

In this aspect, the liquid container is housed in a housing that constitutes an outermost part of the apparatus. With this configuration, the liquid container is housed in a housing that constitutes an outermost part of the apparatus. Accordingly, infiltration of dust or the like into the liquid container can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
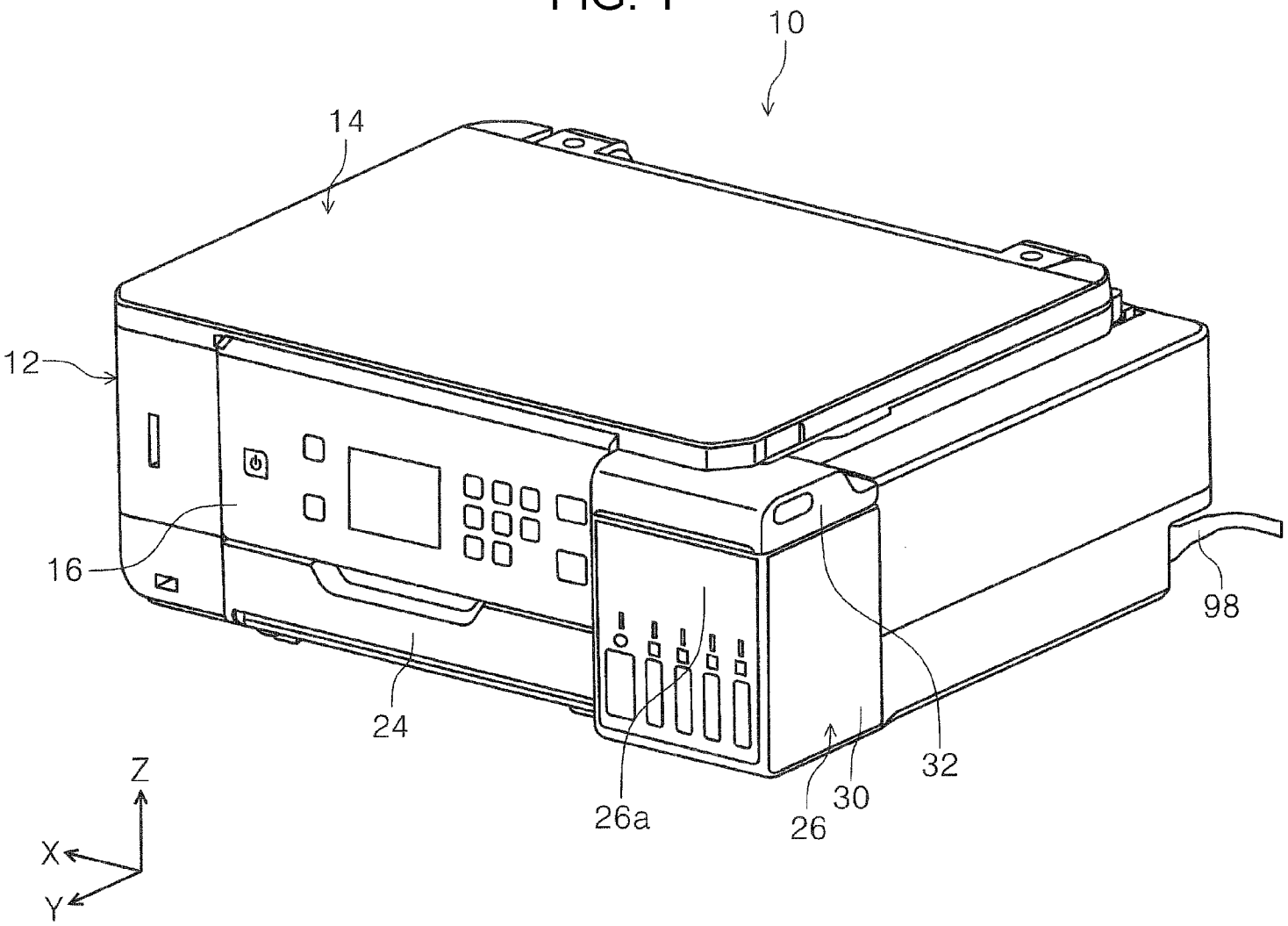
FIG. 1 is an outer appearance perspective view of a printer according to the present invention.

With reference to the drawings, an embodiment of the present invention will be described. Throughout the embodiments, the same components are denoted by the same reference numerals and the description thereof is made only in the embodiment in which the component first appears to avoid duplication of description in the subsequent embodiments.

Figure 2:
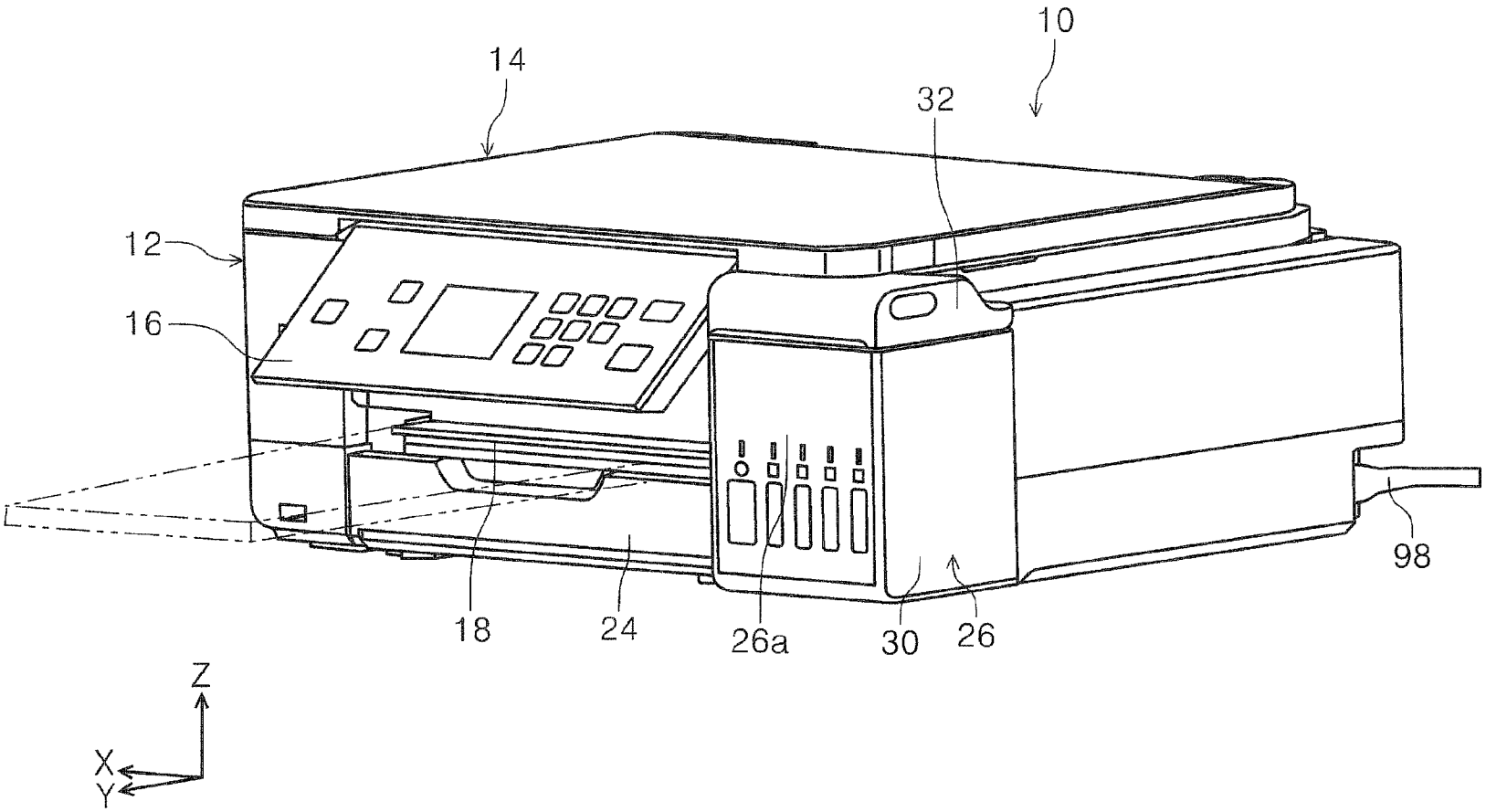
FIG. 2 is an outer appearance perspective view of the printer in a state where an operation section has been rotated toward a front surface in an apparatus depth direction.
Figure 3:
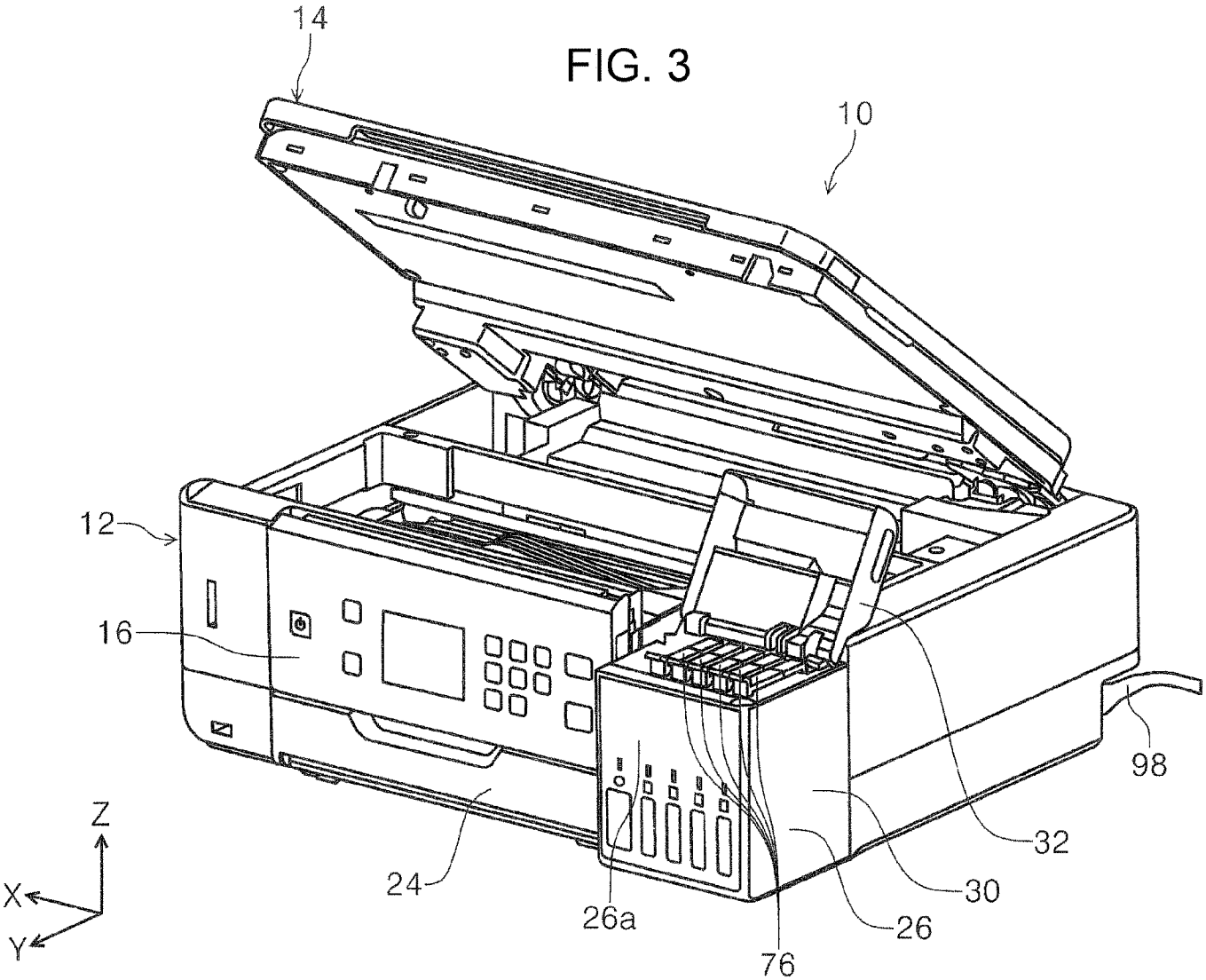
FIG. 3 is an outer appearance perspective view of the printer in which a scanner section and an ink tank cover are in an open state to an apparatus main body.
Figure 4:
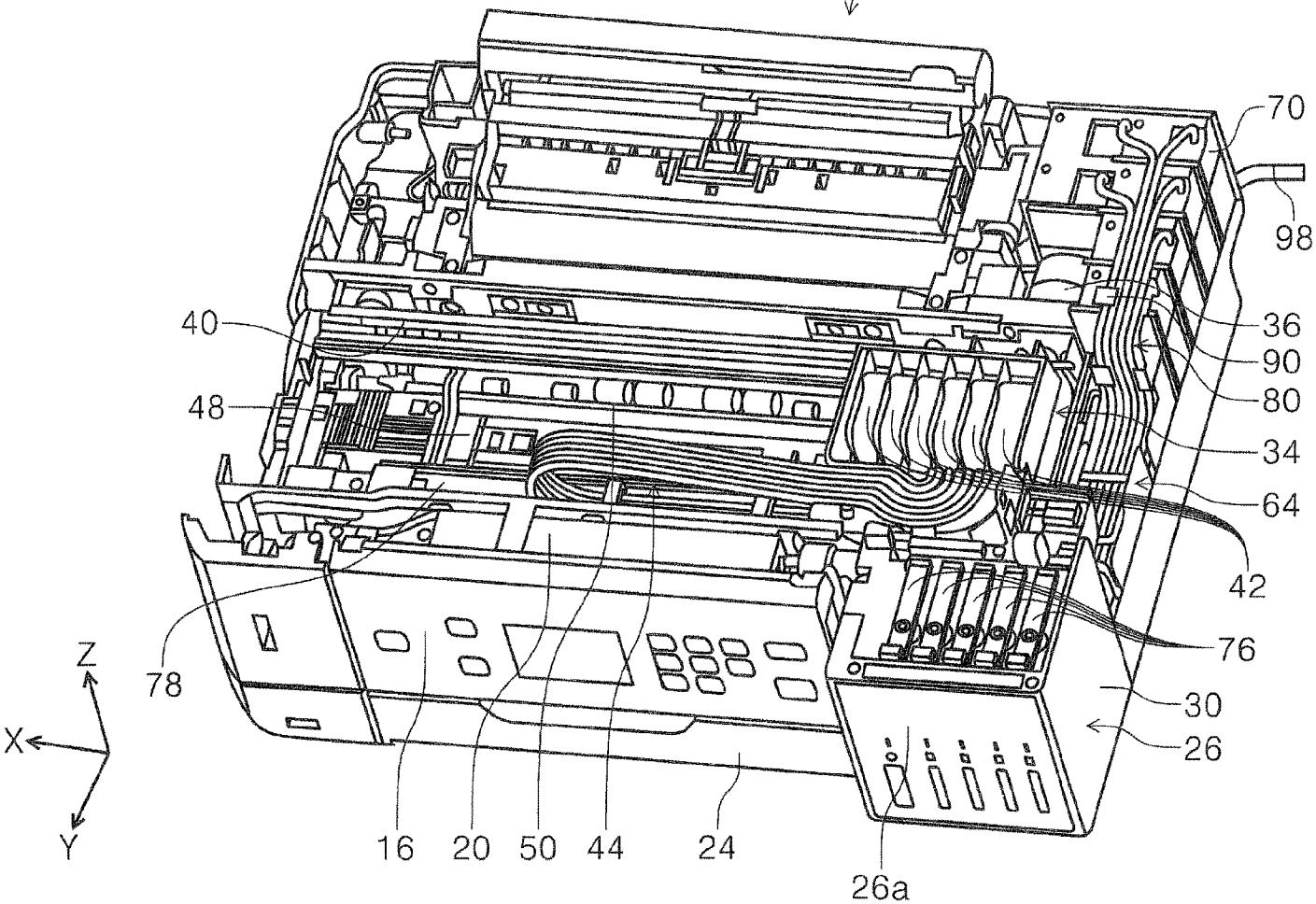
FIG. 4 is an outer appearance perspective view of an apparatus main body.
Figure 5:
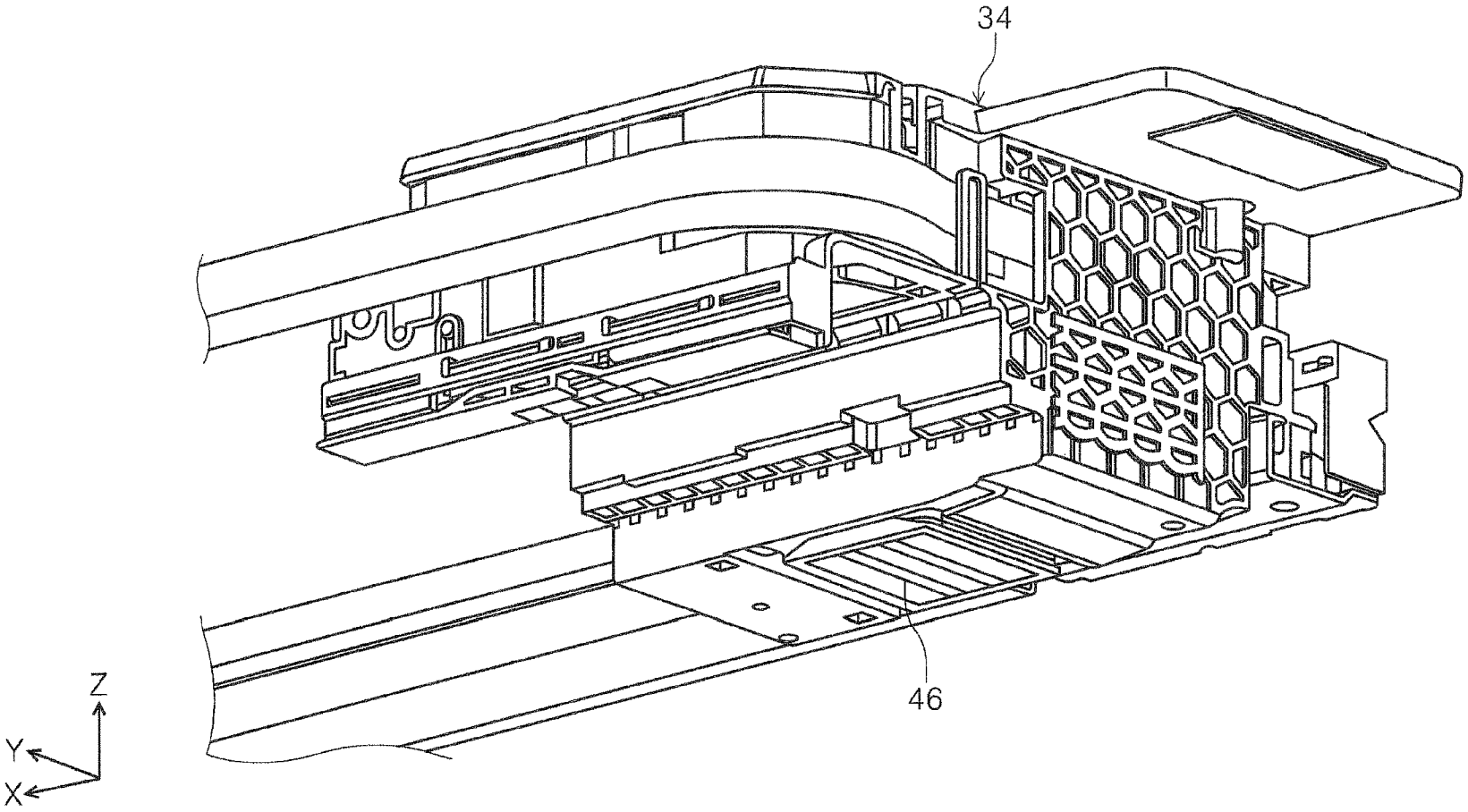
FIG. 5 is a perspective view of a carriage as viewed from obliquely below in an apparatus height direction.
Figure 6:
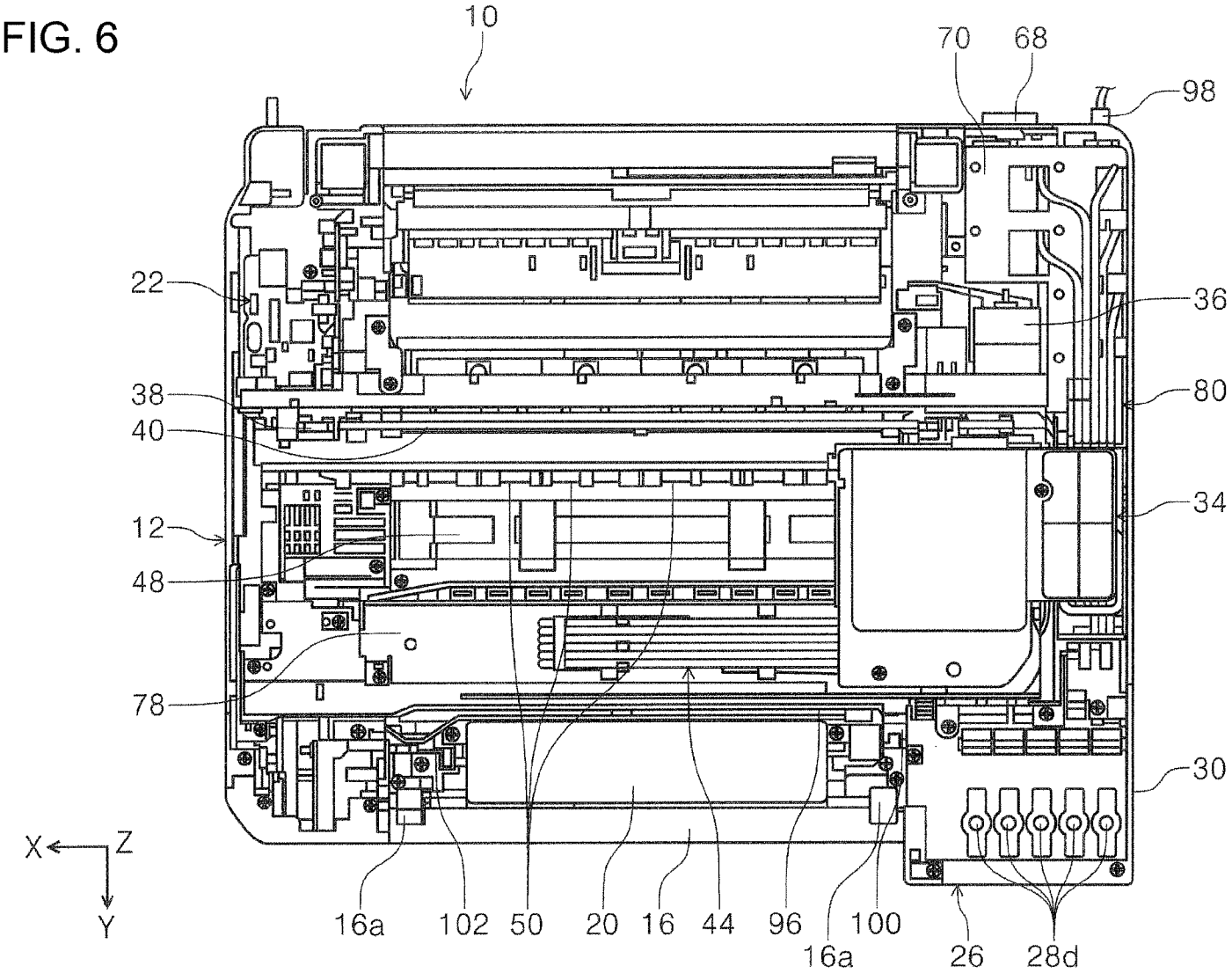
FIG. 6 is a plan view of an apparatus main body.

FIG. 1 is an outer appearance perspective view of a printer according to the present invention, FIG. 2 is an outer appearance perspective view of the printer in a state where an operation section has been rotated toward a front surface in an apparatus depth direction, FIG. 3 is an outer appearance perspective view of the printer in which a scanner section and an ink tank cover are in an open state to an apparatus main body, FIG. 4 is an outer appearance perspective view of an apparatus main body, FIG. 5 is a perspective view of a carriage as viewed from obliquely below in an apparatus height direction, and FIG. 6 is a plan view of an apparatus main body.

Figure 7:
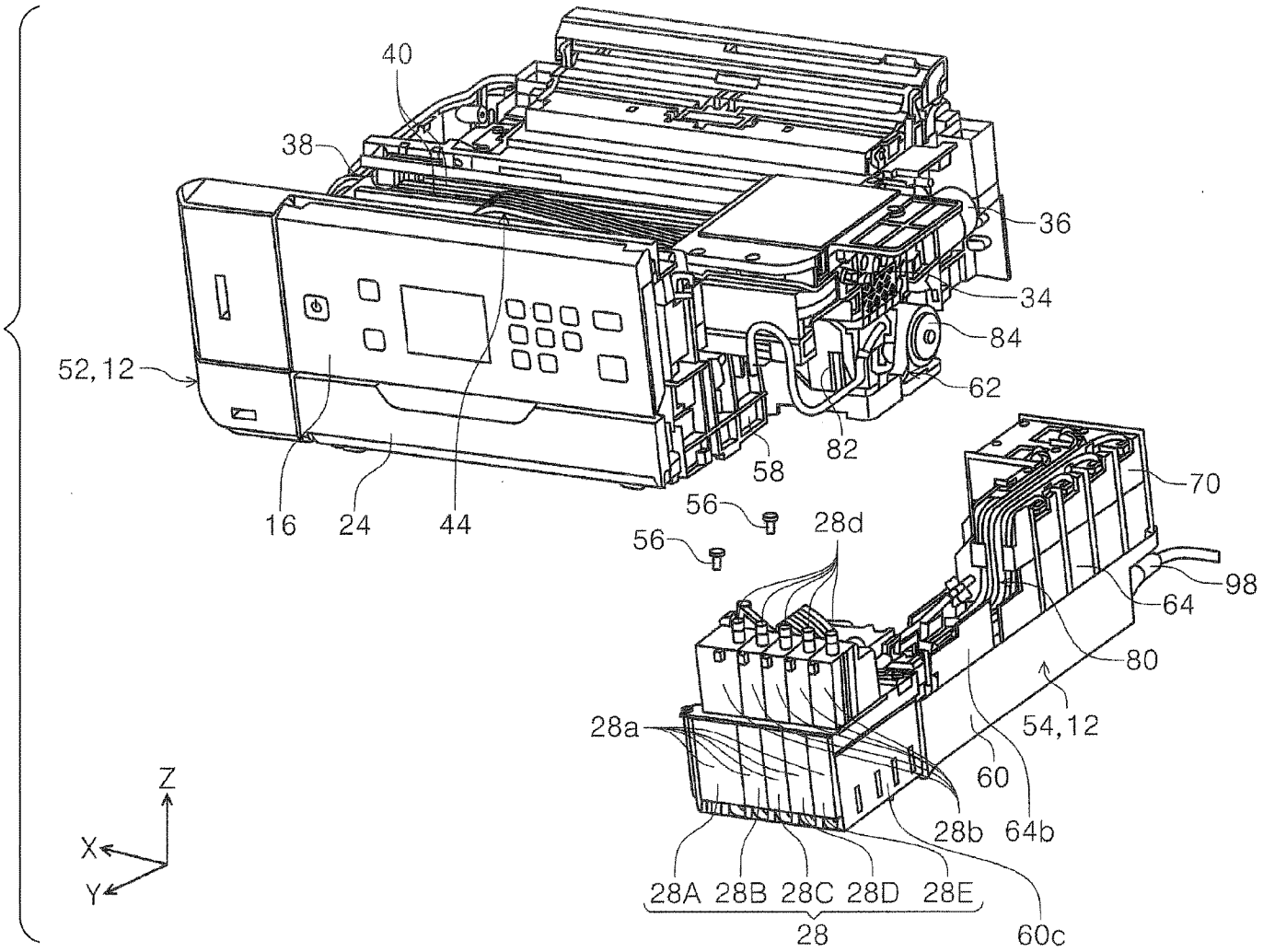
FIG. 7 is an exploded perspective view of a recording unit and an ink supply unit that constitute the apparatus main body.
Figure 8:
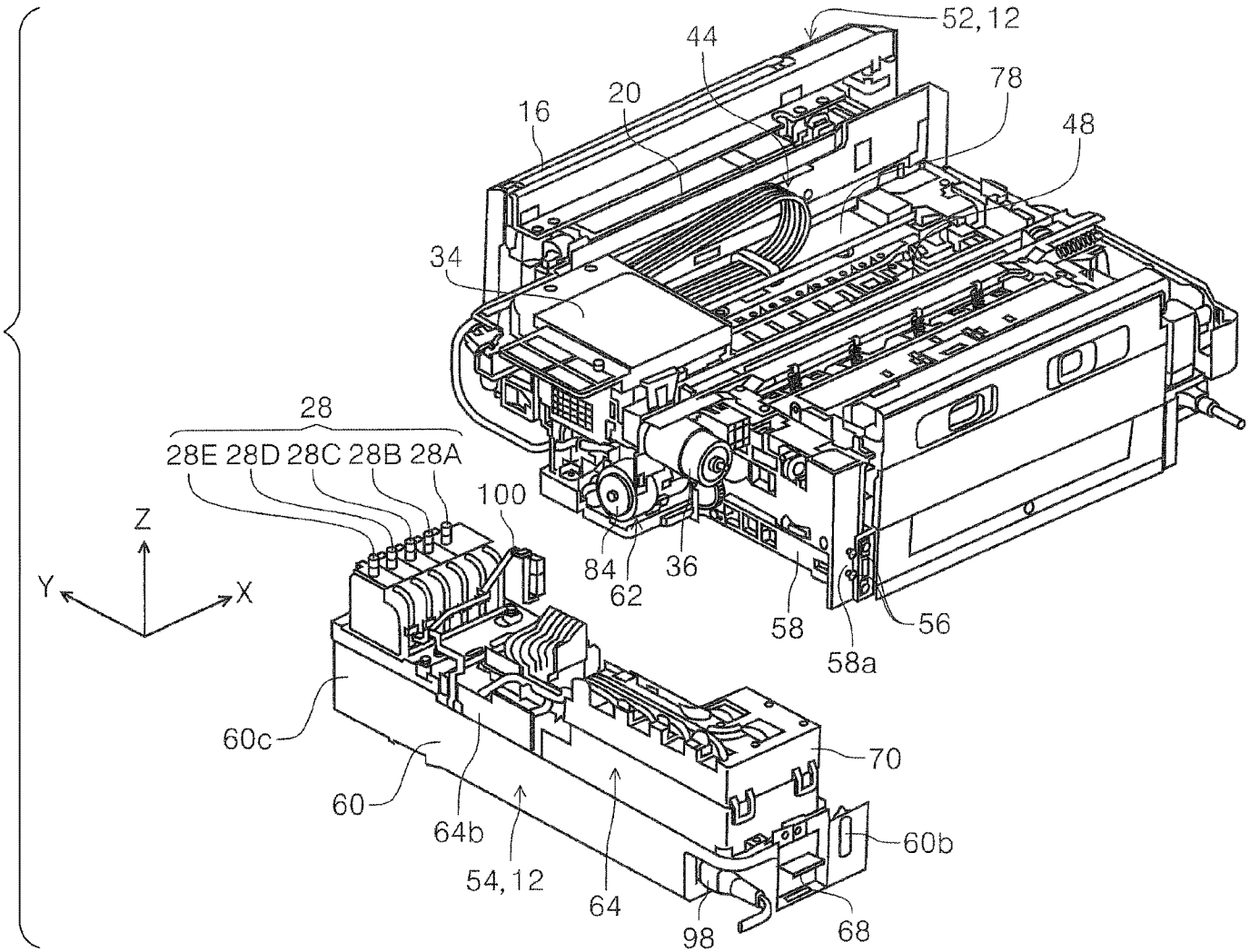
FIG. 8 is an exploded perspective view of a recording unit and an ink supply unit that constitute the apparatus main body.
Figure 9:
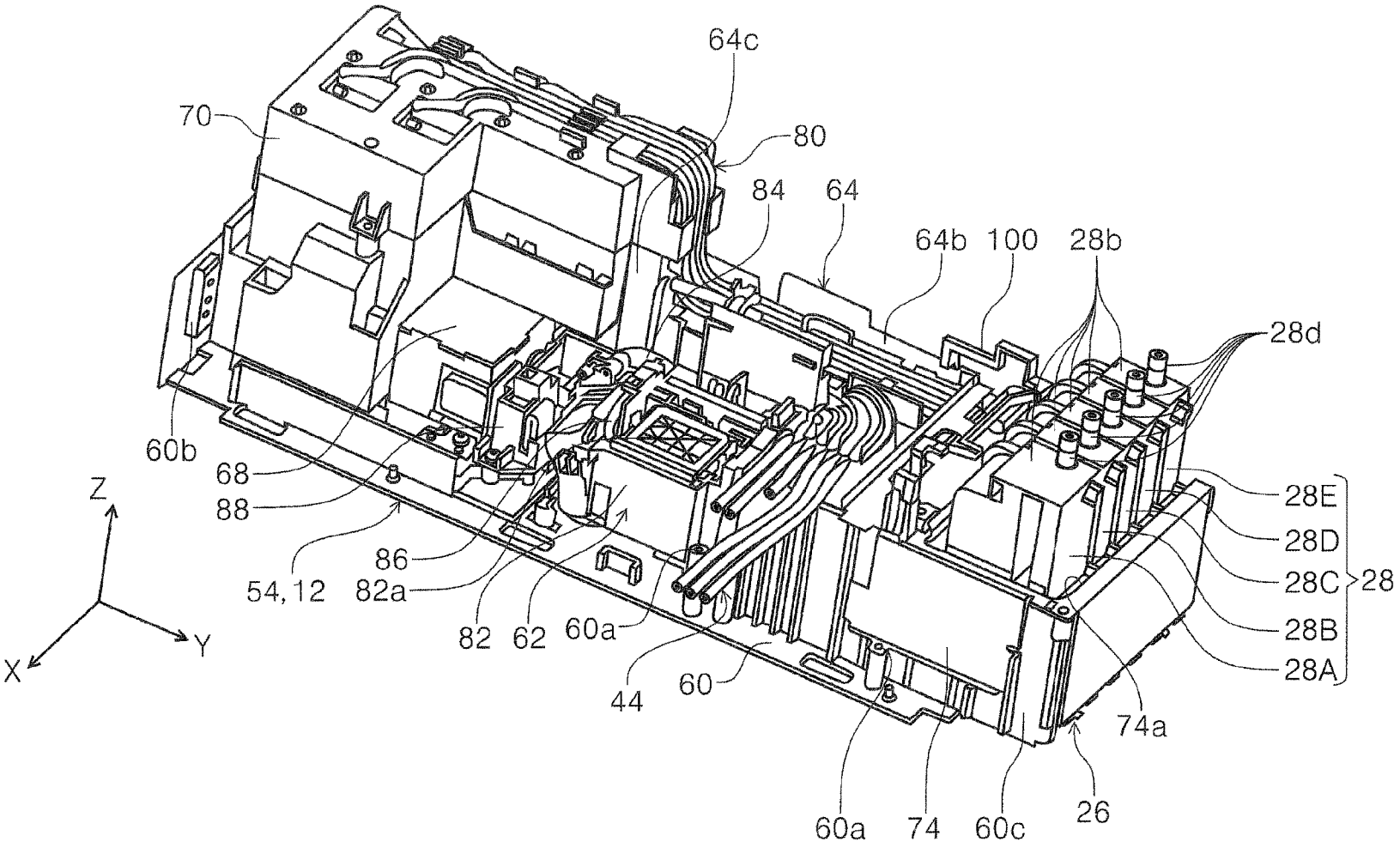
FIG. 9 is a perspective view of an ink supply unit.
Figure 10:
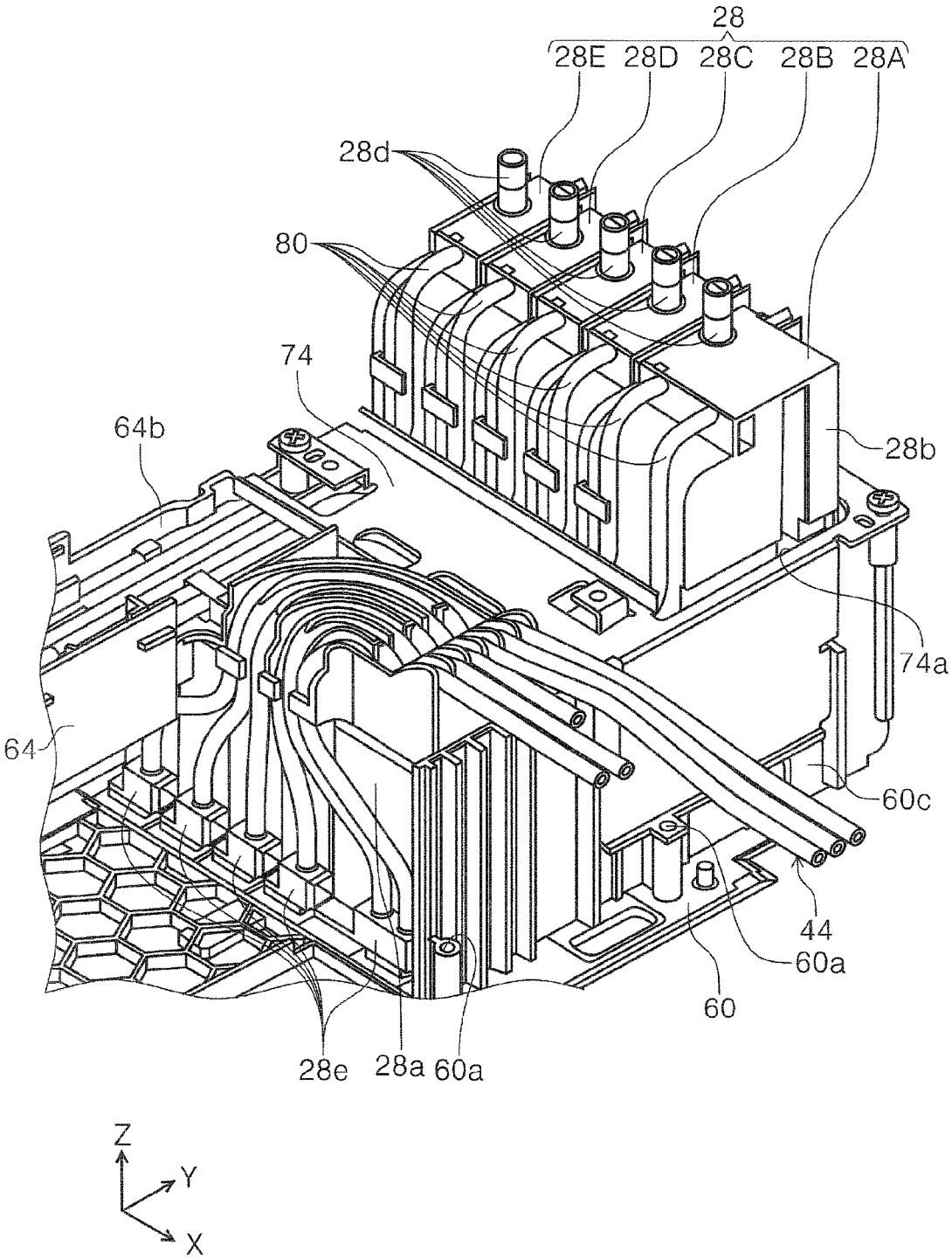
FIG. 10 is a perspective view of the ink tank.
Figure 11:
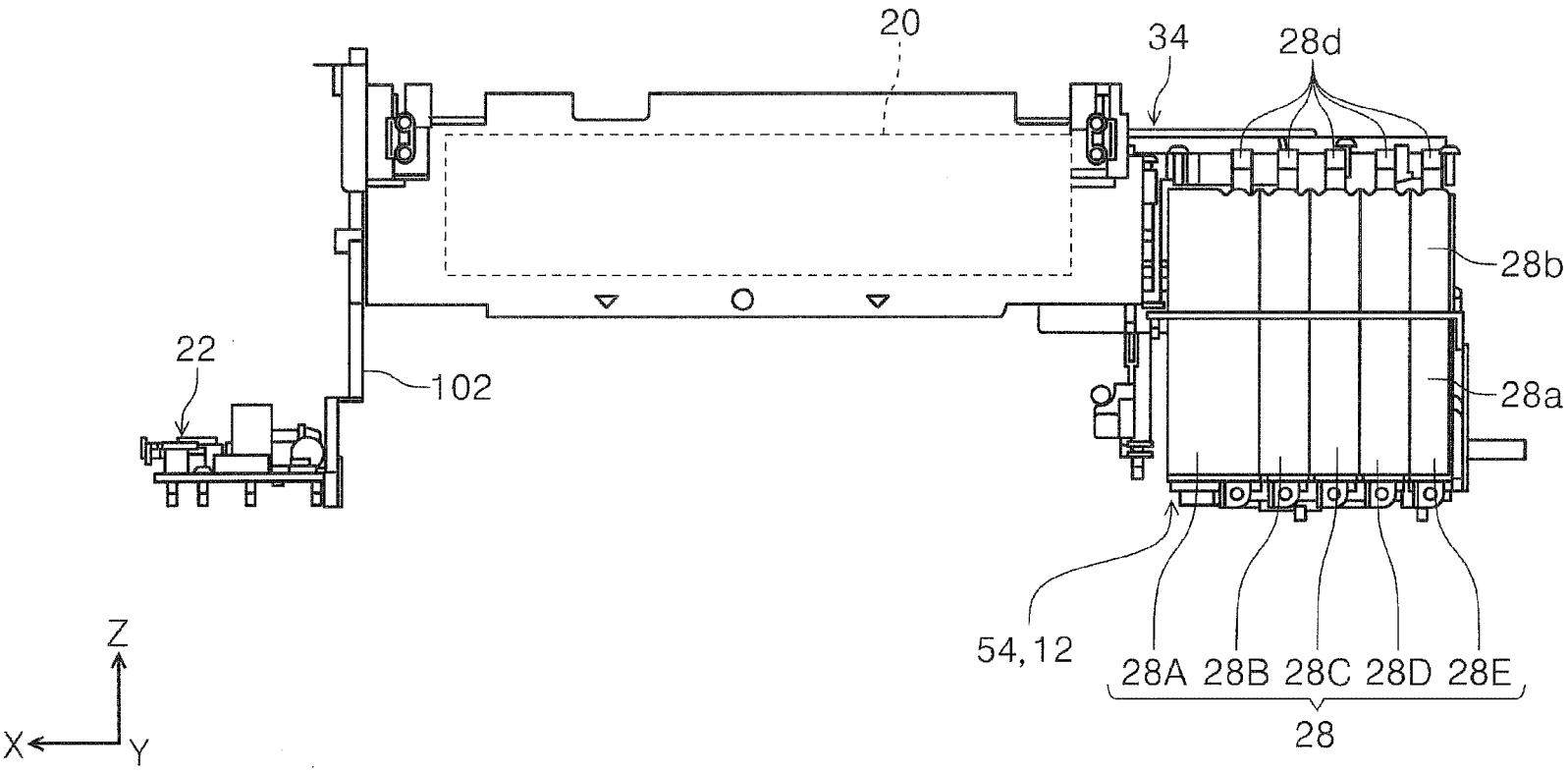
FIG. 11 is a front view of a control unit, a power supply unit, and the ink tank.
Figure 12:
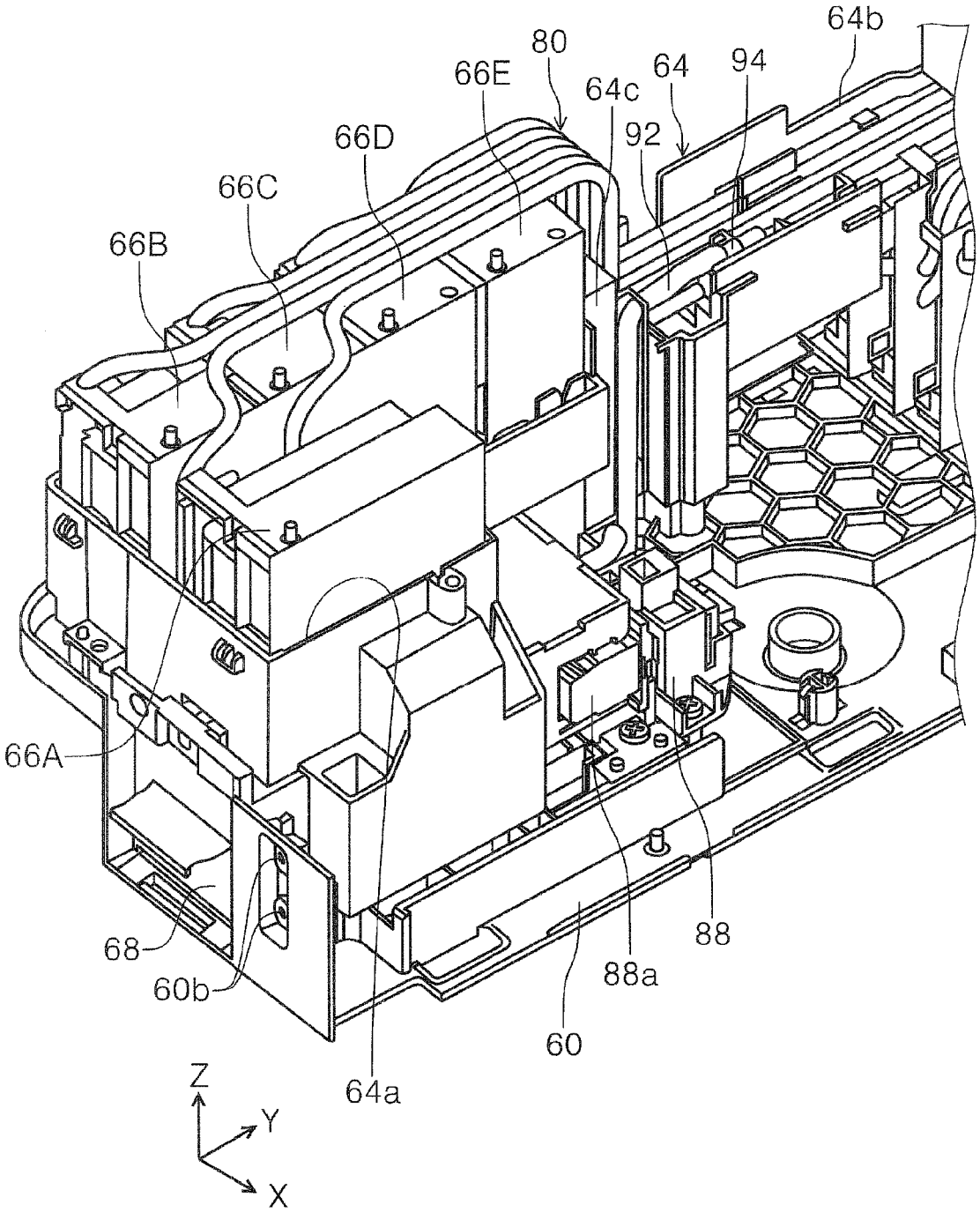
FIG. 12 is a perspective view of a buffer tank and a waste ink tank in the ink supply unit.
Figure 13:
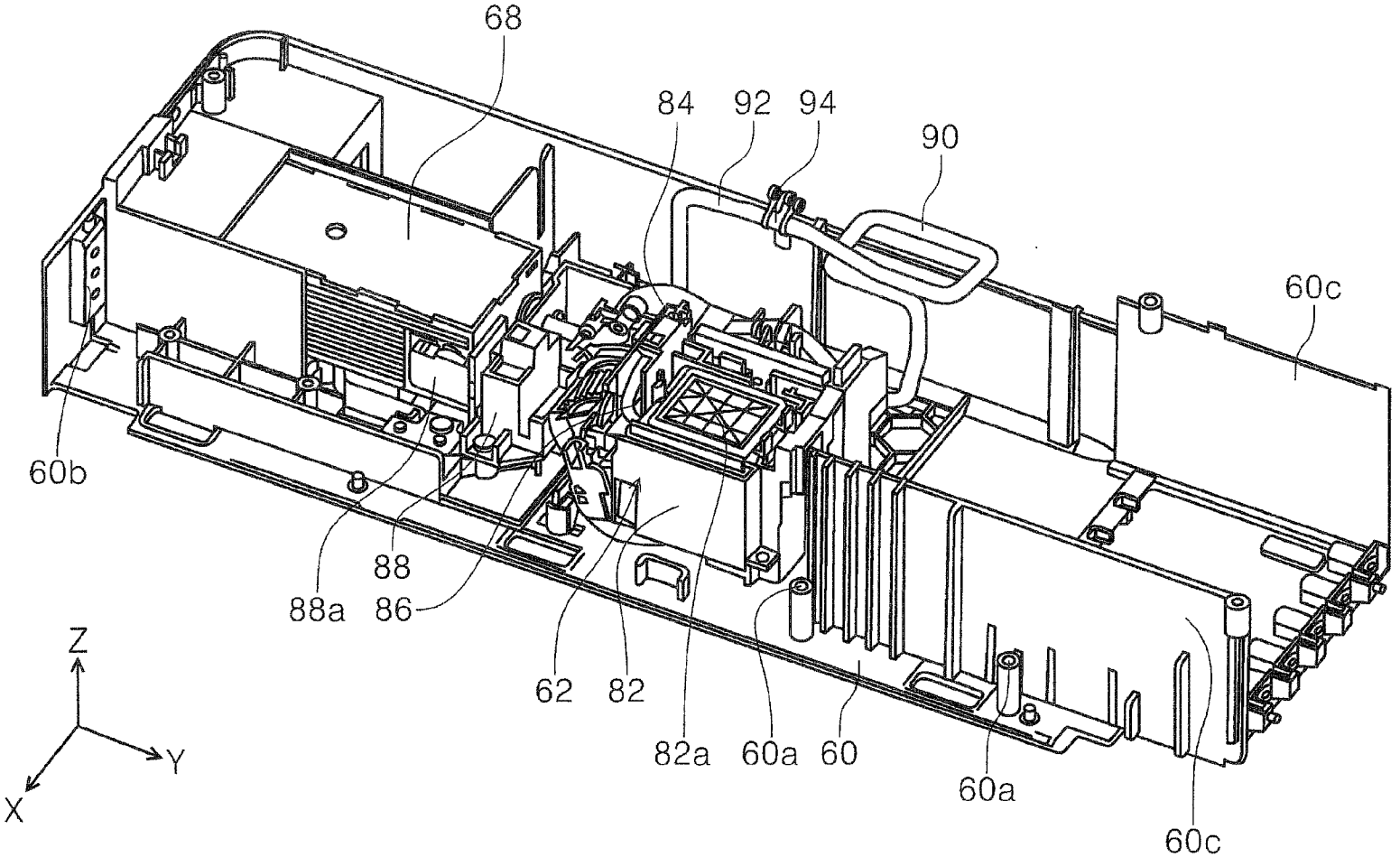
FIG. 13 is a perspective view of a maintenance unit and the waste ink tank.

FIG. 7 is an exploded perspective view of a recording unit and an ink supply unit that constitute the apparatus main body, FIG. 8 is an exploded perspective view of a recording unit and an ink supply unit that constitute the apparatus main body, FIG. 9 is a perspective view of an ink supply unit, FIG. 10 is a perspective view of the ink tank, FIG. 11 is a front view of a control unit, a power supply unit, and the ink tank, FIG. 12 is a perspective view of a buffer tank and a waste ink tank in the ink supply unit, and FIG. 13 is a perspective view of a maintenance unit and the waste ink tank.

Figure 14:
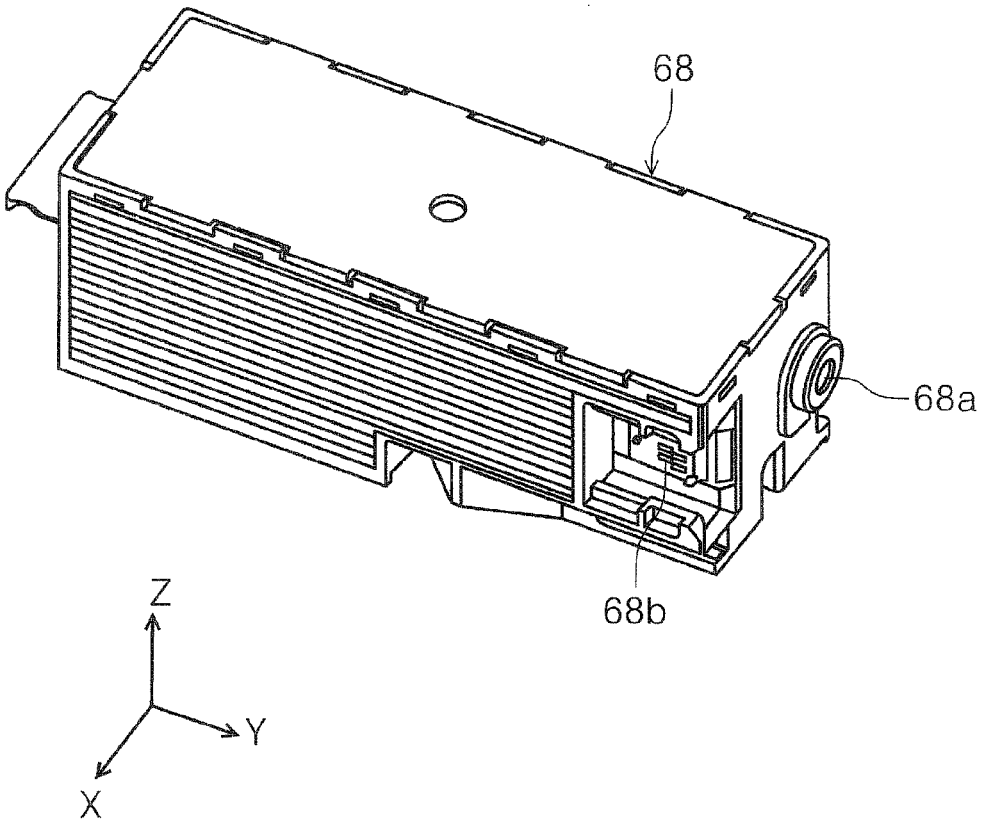
FIG. 14 is a perspective view of the waste liquid tank.
Figure 15:
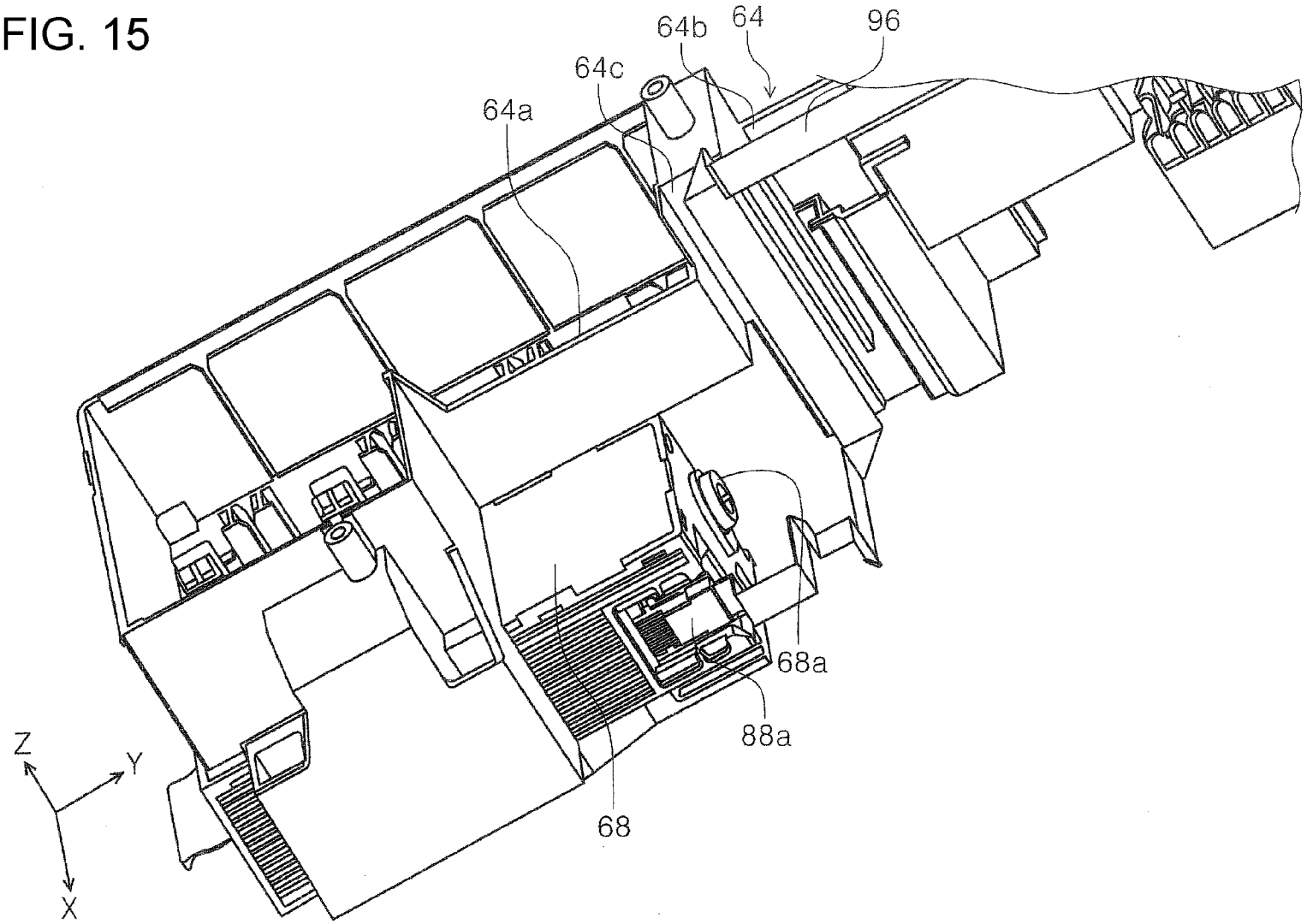
FIG. 15 is a perspective view of a wiring holding section of a container holding member and an electric wiring.
Figure 16:
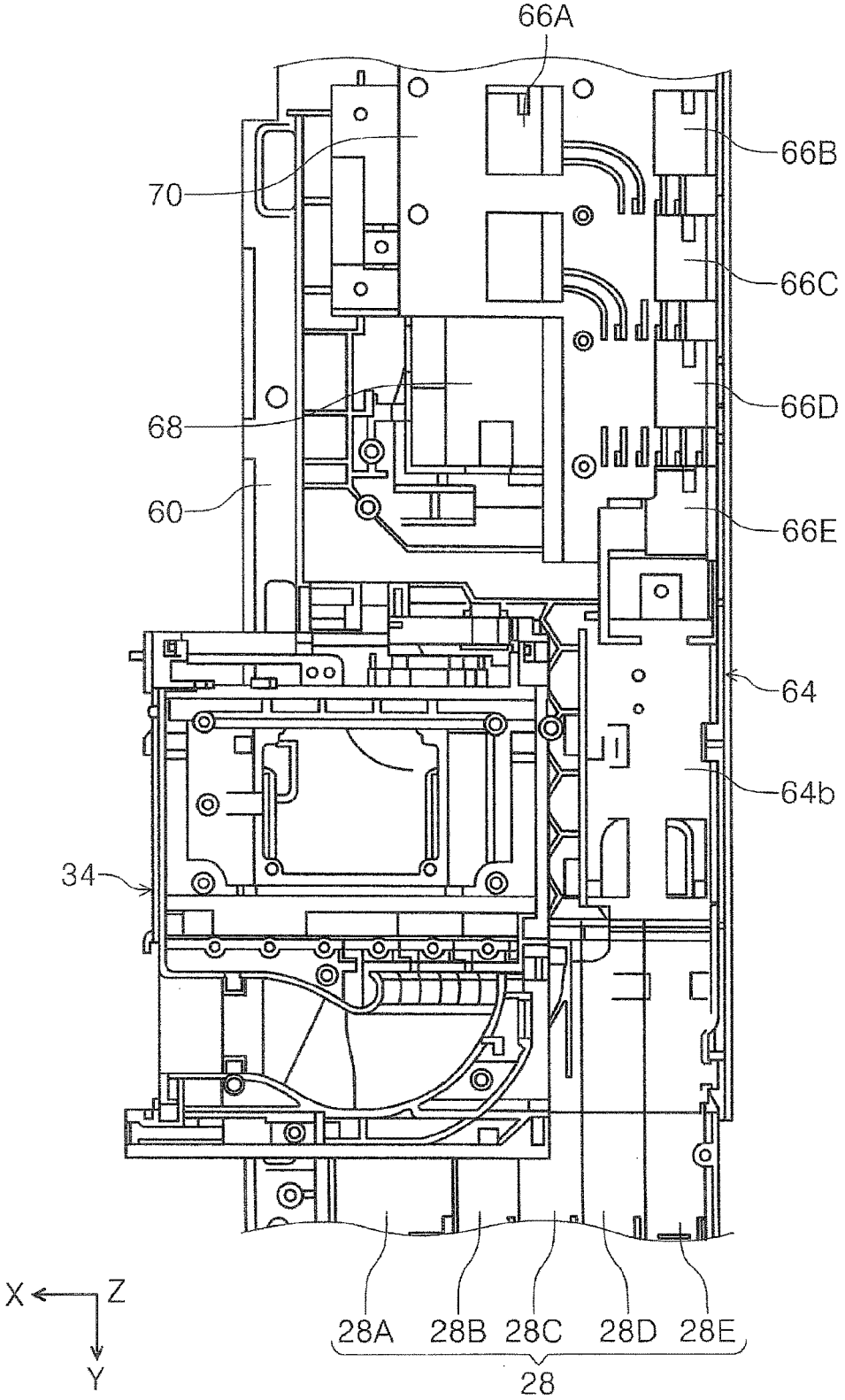
FIG. 16 is a plan view of the carriage, the waste liquid tank and the buffer tank that illustrates a positional relationship in the apparatus width direction.
Figure 17:
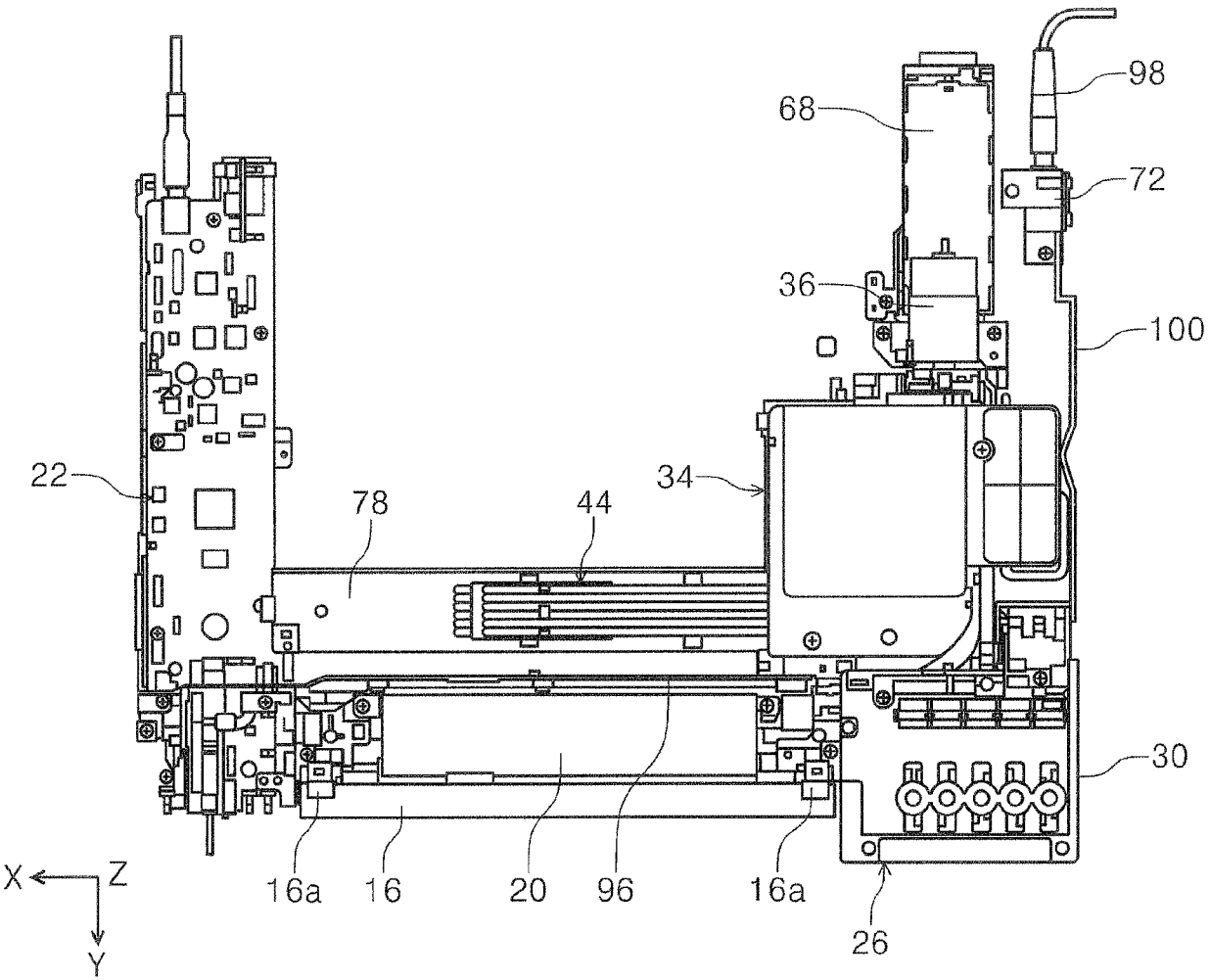
FIG. 17 is a plan view of the control unit, the power supply unit, an ink tank unit, and the waste ink tank.
Figure 18:
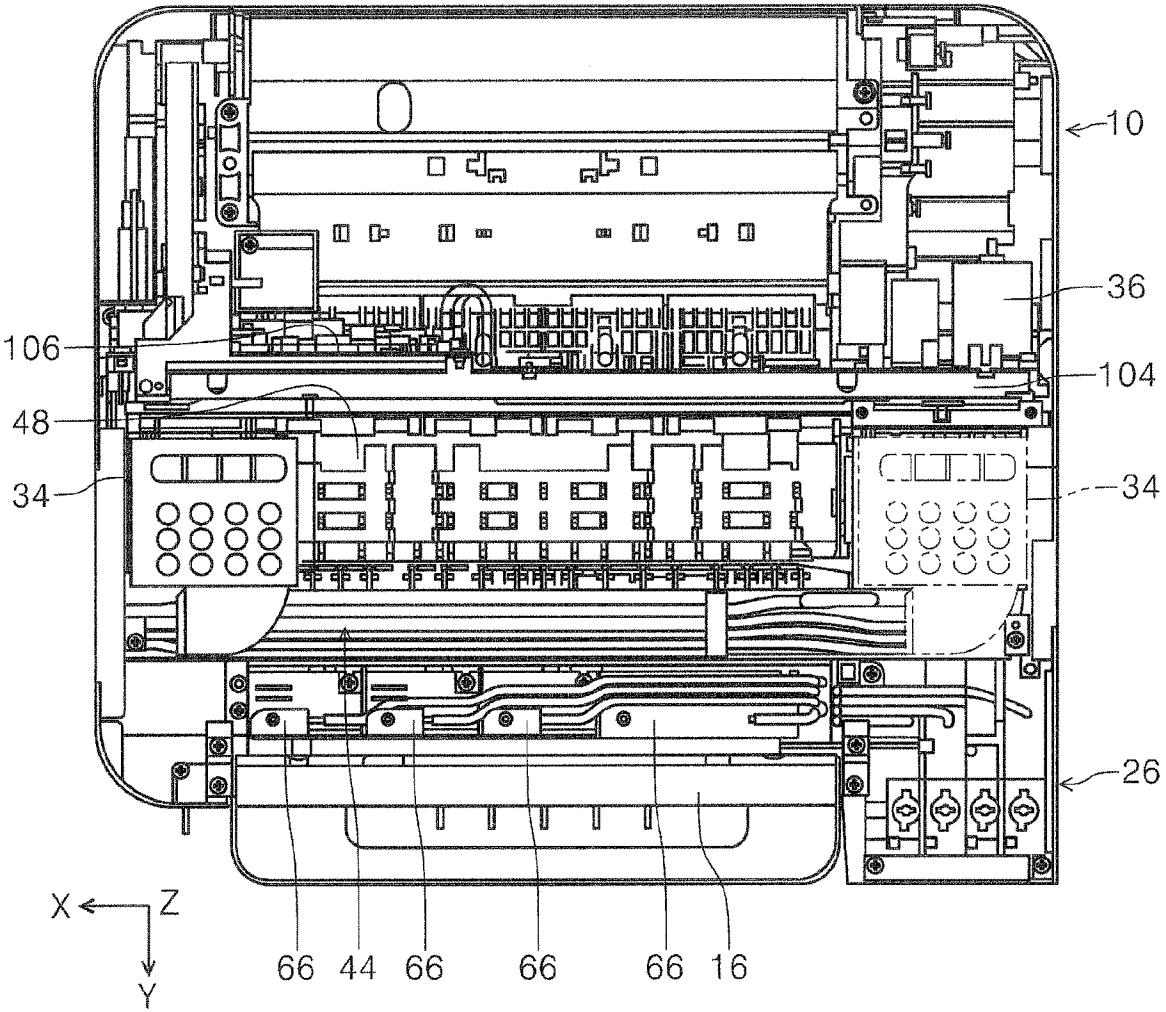
FIG. 18 is a plan view that illustrates a modification of positioning of the buffer tank in the apparatus main body.
Figure 19:
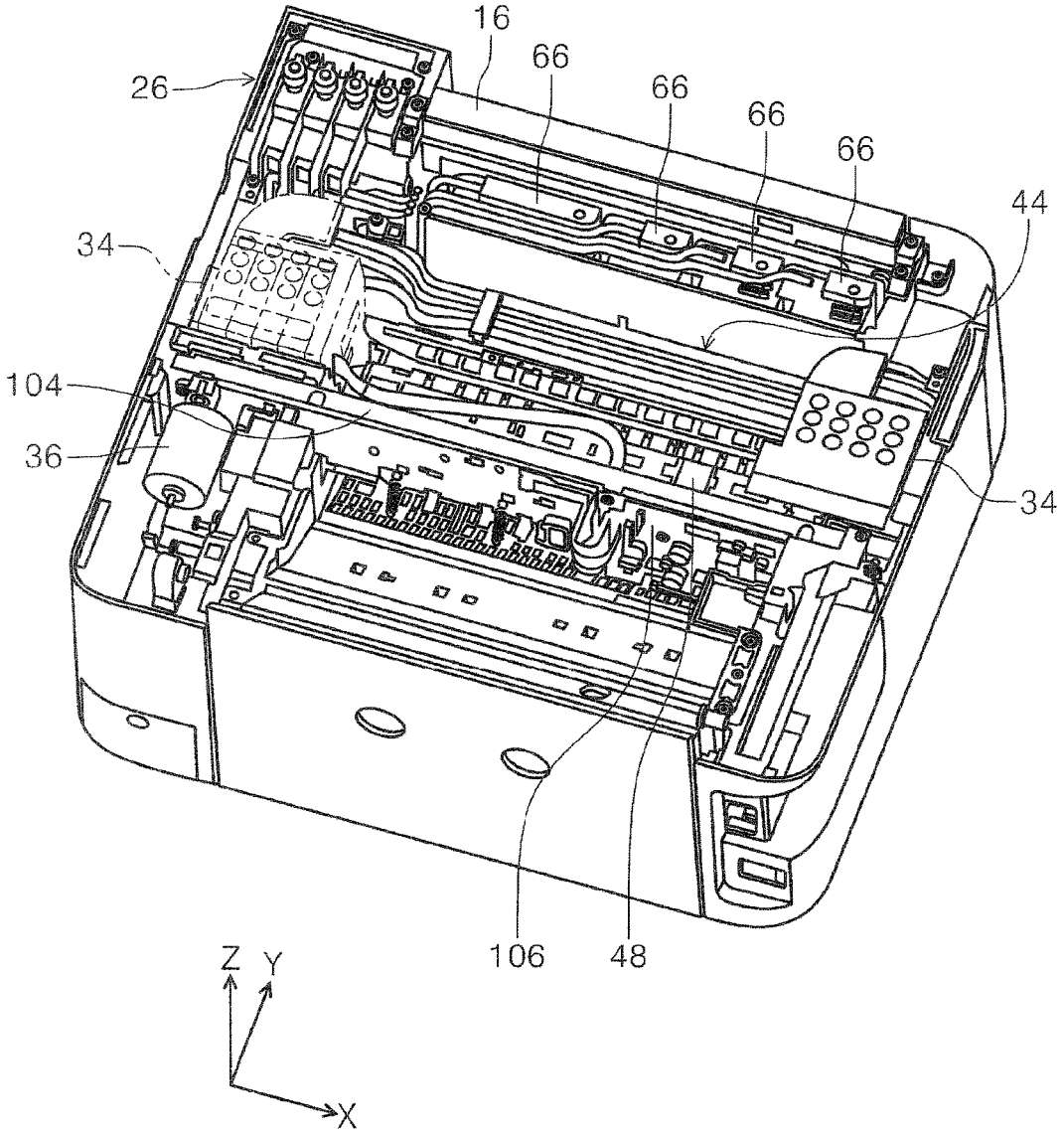
FIG. 19 is a perspective view that illustrates a modification of positioning of the buffer tank in the apparatus main body.

FIG. 14 is a perspective view of the waste liquid tank, FIG. 15 is a perspective view of a wiring holding section of a container holding member and an electric wiring, FIG. 16 is a plan view of the carriage, the waste liquid tank and the buffer tank that illustrates a positional relationship in the apparatus width direction, FIG. 17 is a plan view of the control unit, the power supply unit, an ink tank unit, and the waste ink tank, FIG. 18 is a plan view that illustrates a modification of positioning of the buffer tank in the apparatus main body, and FIG. 19 is a perspective view that illustrates a modification of positioning of the buffer tank in the apparatus main body.

Further, in the X-Y-Z coordinate system in the drawings, the X direction represents a main scan direction (movement direction) of the carriage, that is, a width direction of the recording apparatus, the Y direction represents a depth direction of the recording apparatus, and the Z direction represents a height direction of the recording apparatus. Throughout the drawings, +X direction represents the apparatus left side, −X direction represents the apparatus right side, +Y direction represents the apparatus front side, −Y direction represents the apparatus rear side, +Z direction represents the apparatus upper side, and −Z direction represents the apparatus lower side.

FIRST EXAMPLE

Overview of Printer

With reference to FIGS. 1 to 4, a printer 10 as an example of the liquid ejecting apparatus. With reference to FIGS. 1 to 4, a printer 10 as an example of the liquid ejecting apparatus. The printer 10 includes an apparatus main body 12 and a scanner 14 disposed on the apparatus main body 12.

An operation panel 16 is disposed on the front side in the depth direction of the apparatus main body 12. The operation panel 16 is provided with a display means such as a liquid crystal panel as shown in FIGS. 1 to 4, and an input means having a plurality of input buttons and switches. Further, hinge sections 16*a* (see FIG. 6) are disposed on each end in the apparatus width direction of the operation panel 16. The operation panel 16 is rotatably mounted on the front side in the apparatus depth direction of the apparatus main body 12 via the hinge section 16*a* as shown in FIG. 2.

Further, as shown in FIG. 2, when the operation panel 16 has been rotated forward in the apparatus depth direction relative to the apparatus main body 12, a medium output tray 18 housed in the apparatus main body 12 is exposed. The medium output tray 18 is configured to move backward and forward between a position in which it is housed in the apparatus main body 12 (see the solid line in FIG. 2) and a position in which it is pulled out from the apparatus main body 12 in a direction toward the front side in the apparatus depth direction (see two-dotted chain line in FIG. 2).

With reference to FIGS. 4 and 6, a power supply section 20 that extends in the apparatus width direction and supplies electric power to a driving element of the printer 10 is disposed on the rear side of the operation panel 16 in the apparatus depth direction. Further, the power supply section 20 supplies electric power to a control section 22 (see FIGS. 6, 11 and 17) disposed in the apparatus main body 12. The control section 22, which serves as a "circuit substrate," will be described later.

Moreover, a medium storing section 24 that can house a medium is disposed on the lower side of the medium output tray 18 in the apparatus height direction in the apparatus main body 12. The medium storing section 24 is removably inserted into the apparatus main body 12 from the front side in the apparatus depth direction.

With reference to FIG. 3, the scanner 14 is configured to rotate relative to the apparatus main body 12 about a rear side of the apparatus in the depth direction, and is movable between a closed position (see FIGS. 1 and 2) and an open position (see FIG. 3) to the apparatus main body 12.

Further, an ink tank section 26 is provided on the apparatus main body 12 on the right end in the apparatus width direction and on the front side in the apparatus depth direction in FIGS. 1 to 4. The ink tank section 26 includes a plurality of ink tanks 28 (see FIGS. 9 and 10) as liquid containers, a housing 30 that covers the plurality of ink tanks 28, and a cover 32 mounted to be rotatable to the housing 30. Further, the housing 30 constitutes a portion of the outermost part of the apparatus main body 12.

The ink tank section 26 is disposed to be located under the scanner 14 in the apparatus width direction when the scanner 14 is in at least partially closed position. In the present embodiment, five ink tanks 28 are disposed as shown in FIGS. 9 and 10, and the ink tanks 28 store black, magenta, yellow, cyan and photo black colors of ink as the "liquid." Further, a display section 26*a* is provided on the front side of the ink tank section 26 in the apparatus depth direction so that the remaining amount of ink in the ink tanks 28 can be observed.

When the scanner 14 assumes an open position to the apparatus main body 12, the cover 32 that is disposed on the upper part of the housing 30 in the ink tank section 26 and covers the upper part of the ink tanks 28 is completely exposed. The cover 32 is rotatably mounted to the housing 30. When the cover 32 is completely exposed, upper parts of the ink tanks 28 can be exposed by rotating the cover 32 relative to the housing 30 as shown in FIG. 3. The configuration of the ink tanks 28 will be described later.

Referring now to FIGS. 4 and 6, a carriage 34 is disposed on a rear side of the ink tank section 26 in the apparatus depth direction. As an example, the carriage 34 is configured to reciprocate in the apparatus width direction in the apparatus main body 12. To describe the driving mechanism of the carriage 34 more specifically, a driving motor 36 is disposed on a rear side of the carriage 34 in the apparatus depth direction.

A driving pulley, which is not shown, is provided on a driving shat of the driving motor 36. Further, a driven pulley 38 (see FIG. 6) is disposed in the apparatus main body 12 spaced from the driving pulley (not shown) in the apparatus width direction in a manner rotatable by the driving pulley. An endless belt 40 (see also FIGS. 4 and 6) is wound around the driving pulley (not shown) and the driven pulley 38. Although not shown in the figure, at least part of the endless belt 40 is held by the carriage 34 on the rear end of the carriage 34. As the driving motor 36 rotates, the endless belt 40 is rotated in the same direction as the rotation direction of the driving motor 36 to thereby move the carriage 34 in the apparatus width direction. In addition, a position of the carriage 34 in the apparatus main body 12 as shown in FIG. 4 is set as an example of a home position of the carriage 34.

Further, as shown in FIG. 4, the carriage 34 is provided with a plurality of relay adapters 42. The respective relay adapters 42 are connected to the ink tank 28 via ink supplying tubes 44. Further, as shown in FIG. 5, a recording head 46, which is a "liquid ejecting section" is disposed in the lower part of the carriage 34. On the underside of the recording head 46, a plurality of nozzles that eject ink is provided. Moreover, the relay adapters 42 are configured to supply ink to the nozzles of the recording head 46.

Further, in FIG. 4, a medium support member 48 that extends in the apparatus width direction is disposed under the recording head 46. Further, a pair of transportation rollers 50 is disposed on the rear side of the medium support member 48 in the apparatus depth direction.

To describe a recording operation of the medium of the printer 10, the medium housed in the medium storing section 24 is fed to the pair of transportation rollers 50 by a feeding means, which is not shown in the figure. Then, the medium is nipped by the pair of transportation rollers 50, and is transported to a region under the recording head 46 and facing the recording head 44. The medium supported by the medium support member 48 receives ink ejected from the nozzles of the recording head 46 on the surface facing the recording head 46. Thus, recording is performed on the surface of the medium which faces the recording head 46. Then, the medium on which recording is performed is outputted to the medium output tray 18 which protrudes forward in the apparatus depth direction of the apparatus main body 12.

Attachment and Detachment of Recording Unit and Ink Supply Unit

Next, referring to FIGS. 7 to 9, the configuration of the apparatus main body 12 will be described. The apparatus main body 12 includes a recording unit 52 which includes the carriage 34 having the recording head 46, and an ink supply unit 54 which is configured to be detachable from the recording unit 52. As an example, the ink supply unit 54 is attached to the recording unit 52 via a fastening member 56 shown in FIG. 7. In the present embodiment, the fastening member 56 is provided as a screw member.

Attachment and detachment of the recording unit 52 and the ink supply unit 54 will be more specifically described below. The recording unit 52 includes a main base member 58 that constitutes part of the base of the apparatus main body 12. The recording unit 52, having the main base member 58 as a base member, includes the operation panel 16, the power supply section 20, the control section 22, the medium storing section 24, the carriage 34, and the like. As shown in FIG. 8, a fastened section 58*a* is disposed on the rear side of the main base member 58. Further, although not shown in the figure, a plurality of fastened sections is further provided on the main base member 58 on the front side in the apparatus depth direction and on the right end in the apparatus width direction.

Further, the ink supply unit 54 includes a sub base member 60 that constitutes part of the base of the apparatus main body 12. Referring to FIGS. 9, 10 and 13, fastening sections 60*a* are disposed at two positions on the sub base member 60 close to the front surface in the apparatus depth direction. Further, referring to FIGS. 8, 9, 12 and 13, a fastening section 60*b* is disposed at a position on the rear end of the sub base member 60 in the apparatus depth direction.

In the present embodiment, the ink supply unit 54 is attached on the right end of the recording unit 52 in the apparatus width direction. More specifically, the fastening section 60*b* of the sub base member 60 is connected to the fastened section 58*a* of the main base member 58 of the recording unit 52 via two fastening members 56. Further, the fastening section 60*a* of the sub base member 60 is connected to a plurality of fastened sections (not shown) disposed on the front side of the main base member 60 in the apparatus depth direction, for example, via two fastening members 56. That is, the ink supply unit 54 is mounted on the recording unit 52 via four fastening members 56, and constitutes the apparatus main body 12.

Configuration of Ink Supply Unit

Next, referring to FIG. 9, the configuration of the ink supply unit 54 will be described. Although a maintenance unit 62, which will be described later in conjunction with FIGS. 9 and 13, is illustrated on the ink supply unit 54 for the convenience of description, it is disposed on the recording unit 52 as shown in FIGS. 7 and 8.

With reference to FIG. 9, the sub base member 60 includes the ink tank 28, a first container holding member 64, a buffer tank 66 (see FIG. 12) as a "buffer container," a waste liquid tank 68 as a "waste liquid container," a second container holding member 70, and an inlet 72 (see FIG. 17).

As shown in FIG. 9, the plurality of ink tanks 28 is disposed on the front side of the sub base member 60 in the apparatus depth direction. Further, the buffer tank 66 and the waste liquid tank 68 are disposed on the rear side of the sub base member 60 in the apparatus depth direction. Further, the maintenance unit 62 is disposed in the gap between the ink tank 28, and the buffer tank 66 and the waste liquid tank 68 in the apparatus depth direction of the sub base member 60.

Ink Tank

With reference to FIGS. 7 to 11, the ink tank 28 of the present embodiment includes five ink tanks 28A, 28B, 28C, 28D, and 28E (hereinafter, comprehensively referred to as the ink tank 2). The ink tank 28A has a width larger than that of the other ink tanks 28B, 28C, 28D, and 28E. That is, the ink storing amount of the ink tank 28A is larger than that of the other ink tanks 28B, 28C, 28D, and 28E. Further, in the present embodiment, the ink tank 28A stores black ink.

Moreover, the ink tank 28 includes an ink storing section 28*a* (see FIGS. 10 and 11) which extends in the front-back direction in the apparatus depth direction on the lower side in the apparatus height direction, and an ink introducing section 28*b* which extends upward in the apparatus height direction from the ink storing section 28*a*. Further, an ink introduction port 28*d* is disposed in the upper part of the ink introducing section 28*b*.

As shown in FIG. 9, the ink tank section 26 is disposed on the front side of the sub base member 60 in the apparatus depth direction. With reference to FIG. 13, walls 60*c*, 60*c* that protrude upward in the apparatus height direction are formed on the front side of the sub base member 60 in the apparatus depth direction and on the opposite ends in the apparatus width direction. As shown in FIGS. 9 and 10, the plurality of ink tanks 28 is disposed on the front side of the sub base member 60 in the apparatus depth direction and between the wall 60*c* and the wall 60*c*.

Further, with reference to FIG. 10, a reinforcement member 74 is hung between the wall 60*c* and the wall 60*c* of the sub base member 60 so as to cover the top of the ink container 28*a*. The reinforcement member 74 reinforces the upper part of the ink storing section 28*a*. Further, an opening 74*a* is formed on the reinforcement member 74, and the ink introducing section 28*b* of the plurality of ink tanks 28 protrudes upward in the apparatus height direction from the opening 74*a*. The reinforcement member 74 is formed by processing a metal material, for example, by a bending work such as sheet metal working and press working.

Further, as shown in FIGS. 3, 4 and 6, the housing 30 is disposed in the ink tank section 26 on the outside of the wall 60*c* of the sub base member 60 to cover the plurality of ink tanks 28 and the walls 60*c*. Further, an ink introduction port cover 76 is rotatably mounted in the upper part of the housing 30 and is configured to switch between the state of closing the ink introduction port 28*d* and the state of opening the ink introduction port 28*d*. The ink introduction port cover 76 can be accessed when the cover 32 in the state closed to the housing 30 (see FIGS. 1 and 2) is rotated backward in the apparatus depth direction (see FIG. 3).

Further, referring to FIG. 10, connecting sections 28*e* are disposed in the lower part on the rear side of the ink storing section 28*a* of the respective ink tanks 28 in the apparatus depth direction. The connecting sections 28*e* are connected to the ink supplying tubes 44 that supply ink to the recording head 46 of the carriage 34.

Each ink supplying tube 44 extends upward in the apparatus height direction from the connecting section 28*e* on the rear end of the ink storing section 28*a* of the ink tanks 28 in the apparatus depth direction. The ink supplying tubes 44 are arrayed in the center part of the sub base member 60 in the apparatus width direction, and turned forward in the apparatus depth direction, and then bent into the moving direction of the carriage 34.

A tube guide member 78 (see FIGS. 6 and 8) which extends in the apparatus width direction is disposed on the rear side of the power supply section 20 in the apparatus depth direction. The ink supplying tubes 44 are guided by the tube guide member 78 to extend from the right to the left in the apparatus width direction, and bent upward in the apparatus height direction, and then turned back to be connected to the relay adapter 42 (see FIG. 4) of the carriage 34.

Further, the upper part of the ink introducing section 28*b* of the ink tank 28 is connected to a first end of a connection tube 80 that connects the ink tank 28 and the buffer tank 66. In the present embodiment, two ink supplying tubes 44 and two connection tubes 80 are led out from the ink tank 28A located leftmost in the apparatus width direction.

Further, referring to FIG. 6, the ink tank unit 26, that is, at least part of the ink tank 28 overlaps at least part of the power supply section 20 in the apparatus depth direction. Further, in the present example, the ink introduction port 28*d* of the ink tank 28 is located on the front side relative to the power supply section 20 in the apparatus depth direction. Further, the ink introduction port 28*d* overlaps at least part of the operation panel 16, specifically, the hinge section 16*a* in the apparatus depth direction. Moreover, referring to FIG. 11, at least part of the ink tank 28 overlaps at least part of the power supply section 20 in the apparatus height direction. The ink introduction port cover 76 is omitted in FIG. 6.

Buffer Tank

With reference to FIGS. 9, 11 and 12, the first container holding member 64 extends in the apparatus depth direction in the ink supply unit 54 on the rear side of the ink tank unit 26 in the apparatus depth direction. The first container holding member 64 includes a buffer tank holding section 64*a* disposed on the rear side in the apparatus depth direction, and a tube guide section 64*b* disposed on the front side in the apparatus depth direction.

As shown in FIG. 12, a plurality of buffer tanks 66A, 66B, 66C, 66D and 66E (hereinafter, comprehensively referred to as the buffer tank 66) is disposed in the buffer tank holding section 64*a* of the first container holding member 64. The same number of the buffer tanks 66 as the ink tanks 28 are provided. The buffer tanks 66A, 66B, 66C, 66D and 66E correspond to the ink tanks 28A, 28B, 28C, 28D and 28E, respectively. Specifically, the buffer tanks 66 are connected to second ends of the connection tubes 80, which are connected to the corresponding ink tanks 28. In this embodiment, the second ends of the two connection tubes 80, which are connected to the ink tank 28A are connected to the buffer tank 66A.

As an example, four buffer tanks 66E, 66D, 66C and 66B having the same volume are arranged on the right side in the apparatus width direction in sequence from the front to the rear side in the apparatus depth direction. Further, the buffer tank 66A having a volume larger than that of the four buffer tanks 66B, 66C, 66D and 66E is disposed on the left side in the apparatus width direction.

As shown in FIG. 15, the waste liquid tank 68 is disposed under the buffer tank holding section 64*a* of the first container holding member 64 in the apparatus height direction. As shown in FIGS. 9 and 12, at least part of the plurality of buffer tanks 66 overlaps at least part of the waste liquid tank 68 in at least one of the apparatus width direction and apparatus depth direction.

Further, as shown in FIG. 9, the second container holding member 70 is attached to the first container holding member 64 so as to cover the buffer tanks 66 held by the buffer tank holding section 64*a* of the first container holding member 64. The connection tubes 80 are led out from the buffer tanks 66 to the upper part of the second container holding member 70. The connection tubes 80 led out to the upper part of the second container holding member 70 are guided by the tube guide section 64*b* of the first container holding member 64 and extends from the rear to front side in the apparatus depth direction to be connected to the ink tanks 28.

The function of the buffer tanks 66 will be described. The buffer tanks 66 are connected to the ink tanks 28 via the connection tubes 80. When the ink introduction port 28*d* is closed by the ink introduction port cover 76, the pressure in the ink tank 28 increases, for example, according to an increase in the temperature surrounding the printer 10. This may cause ink in the ink tank 28 to be pushed into the buffer tank 66.

As an example, the ink storable amount of each buffer tank 66 is set to be substantially the same as the ink storing amount of the ink tank 28 connected by the connection tube 80, or more than that amount. Accordingly, even if the ink stored in the ink tank 28 flows into the buffer tank 66, ink leakage from the buffer tank 66 can be prevented or reduced.

Further, in the present example, a bottom of an ink storing space in the buffer tank 66 in the apparatus height direction is set to be higher than the maximum height of the level of the ink stored in the ink tank 28. With this configuration, the pressure in the ink tank 28 decreases, for example, by rotating the ink introduction port cover 76 to open the ink introduction port 26*d* when ink has flowed into the buffer tank 66 due to increase in the pressure in the ink tank 28, or according to a decrease in the temperature surrounding the printer 10. As a result, ink in the buffer tank 66 is returned into the ink tank 28 via the connection tube 80.

Maintenance Unit and Waste Liquid Tank

With reference to FIGS. 9 and 13, the maintenance unit 62 includes, as an example, a cap section 82 and a suction pump 84. The cap section 82 is located under the recording head 46 of the carriage 34 in the apparatus height direction when the carriage 34 is located at a home position.

The cap section 82 includes a cap 82*a* that can switch between a capped state in which it caps the recording head 46 and an uncapped state in which it is separated from the recording head 46 while the carriage 34 is located at the home position. The cap section 82 is connected to the suction pump 84 via a waste ink tube 82. When the suction pump 84 is driven during the capped state in which the cap 82*a* caps the recording head 46, a negative pressure is applied to the cap 82*a* via the waste ink tube 86 which connect the cap section 82 and the suction pump 84. This negative pressure allows for suctioning of ink from the nozzles of the recording head 46, thereby eliminating clogging of the nozzles and air bubble contamination. Further, the waste ink generated in the cap section 82 is suctioned by the suction pump 84 via the waste ink tube 86.

Referring now to FIG. 13, a waste liquid tank mounting section 88 is disposed in the sub base member 60 on the rear side of the maintenance unit 62 in the apparatus depth direction. The waste liquid tank 68 is attached to the waste liquid tank mounting section 88 in a manner to be removable from the rear side of the sub base member 60 in the apparatus depth direction. The waste liquid tank 68 is configured to store the waste liquid (waste ink) suctioned in the cap section 82 while it is attached to the waste liquid tank mounting section 88.

Further, the maintenance unit 62 and the waste liquid tank mounting section 88 are connected to each other via a first waste liquid tube 90 and a second waste liquid tube 92. Moreover, the first waste liquid tube 90 and the second waste liquid tube 92 are connected to each other via a joint member 94.

A first end of the first waste liquid tube 90 is connected to the maintenance unit 62, more specifically, to the suction pump 84. The first waste liquid tube 90, which extends from the suction pump 84, extends into the tube guide section 64*b* of the first container holding member 64, and is connected to the joint member 94 at a second end thereof. Further, a first end of the second waste liquid tube 92 is connected to the joint member 94. The second waste liquid tube 92 extends to the rear side in the apparatus depth direction, and is connected to the waste liquid tank mounting section 88 at a second end thereof.

With reference to FIG. 14, the waste liquid tank 68 is formed, as an example, in a cuboid shape extending in the apparatus depth direction. Further, a connected connector 68*a* is mounted on the front side in the apparatus depth direction. The connected connector 68*a* is mounted on the waste liquid tank mounting section 88 so as to communicate with the second waste liquid tube 92. In addition, a storage medium 68*b* is disposed on the side surface on the front end in the apparatus depth direction. The storage medium 68*b* is configured to store information such as the waste ink storing amount in the waste liquid tank 68.

Further, the suction pump 84 of the maintenance unit 62 is connected to the connected connector 68*a* of the waste liquid tank 68 via the first waste liquid tube 90, the joint member 94, the second waste liquid tube 92 and the waste liquid tank mounting section 88 when the waste liquid tank 68 is attached to the waste liquid tank mounting section 88. Accordingly, waste liquid (waste ink) suctioned by the suction pump 84 is fed into the waste liquid tank 68 and stored in the waste liquid tank 68.

Positional Relationship among Ink Tank, Buffer Tank and Waste Liquid Tank

Referring to FIG. 16, at least part of the ink tank 28 overlaps at least part of the buffer tank 66 in the apparatus width direction. Further, at least part of the ink tank 28 overlaps at least part of the waste liquid tank 68 in the apparatus width direction. Further, at least part of the ink tank 28 overlaps at least part of the carriage 34 in the apparatus width direction when the carriage 34 is located at the home position.

Control Section

With reference to FIG. 15, the storage medium 68*b* of the waste liquid tank 68 is electrically connected to a contact terminal 88*a* disposed in the waste liquid tank mounting section 88 when the waste liquid tank 68 is mounted in the waste liquid tank mounting section 88. The contact terminal 88*a* is connected to a first end of the signal cable 96. The signal cable 96 is configured, for example, as a flexible flat cable (FFC). The cable 96 extending from the contact terminal 88*a* of the waste liquid tank mounting section 88 is held by a wiring holding section 64*c* disposed between the buffer tank holding section 64*a* and the tube guide section 64*b* in the first container holding member 64 and extends upward in the apparatus height direction.

The signal cable 96 turns to change the direction of the signal cable 96 to the front side in the apparatus depth direction on the upper side of the wiring holding section 64*c*, and extends forward in the apparatus depth direction along the side surface of the tube guide section 64*b* of the first container holding member 64. Then, the signal cable 96 extends in the apparatus depth direction to the rear side of the ink tank 28 in the apparatus depth direction, and then turns left in the apparatus width direction and connected to the control section 22.

As shown in FIGS. 6, 11 and 17, the control section 22 is disposed on the left end in the apparatus width direction in the recording unit 52 that constitutes the apparatus main body 12. Further, the control section 22 is disposed on the lower side in the apparatus height direction on the left end in the apparatus width direction in the recording unit 52. The control section 22 is configured as a circuit substrate having a plurality of electric components and controls operations of the printer 10. Accordingly, when the storage medium 68*b* of the waste liquid tank 68 is electrically connected to the contact terminal 88*a*, the information stored in the storage medium 68*b* of the waste liquid tank 68 is transmitted to the control section 22.

Referring now to FIG. 17, the inlet 72 is disposed on the rear side of the ink tank section 26 in the apparatus depth direction. The inlet 72 is configured to be connected to a power supply cable 98 (see FIGS. 6 and 8) that supplies electric power from an external power source (not shown in the figure) to the inside of the apparatus main body 12.

An electric cable 100 extending from the inlet 72 extends to the front side in the apparatus depth direction and is connected to the power supply section 20 disposed on the rear side of the operation panel 16. The electric cable 100 supplies electric power to the power supply section 20 from an external power source, not shown in the figure, via the inlet 72 and the electric cable 100. An end of the electric cable 100 which is connected to the power supply section 20 is configured as a connector and is configured to be easily detachably attached to the power supply section 20. Further, an electric cable 102 is connected to a left end of the power supply section 20 in the apparatus width direction. As shown in FIG. 11, the electric cable 102 is connected to the control section 22.

In the present example, the ink tank unit 26, that is, the ink tank 28 is disposed on the right end of the apparatus main body 12 in the apparatus width direction, and the control section 22 is disposed on the left end in the apparatus width direction. However, the configuration is not limited thereto, and the ink tank 28 may be disposed on the left end in the apparatus width direction, and the control section 22 may be disposed on the right end in the apparatus width direction.

Modified Embodiments (1) In the present embodiment, the wiring holding section 64*c* that holds the signal cable 96 is provided on the first container holding member 64. However, instead of this configuration, the buffer tank 66 and the like may be configured to hold the signal cable 96.

(2) In the present embodiment, the maintenance unit 62 is provided on the recording unit 52. However, instead of this configuration, the maintenance unit 62 may be provided on the ink supply unit 54.

(3) In the present embodiment, the ink supply unit 54 is provided on the right side of the recording unit 52 in the apparatus width direction. However, instead of this configuration, the ink supply unit 54 may be provided on the left side of the recording unit 52 in the apparatus width direction.

(4) Further, in the present embodiment, the first container holding member 64 and the buffer tank 66 are disposed on the rear side of the ink tank section 26 in the apparatus depth direction. However, instead of this configuration, the first container holding member 64 and the buffer tank 66 may be arranged in the apparatus width direction as shown in FIGS. 18 and 19 at a position where the power supply section 20 is provided in the present embodiment, that is, on the rear side of the operation panel 16 in the apparatus depth direction. In this case, a plurality of buffer tanks 66 is arranged in the apparatus width direction. In this configuration, ink tank unit 26, that is, at least part of the ink tank 28 overlaps at least part of the buffer tank 66 in the apparatus depth direction.

(5) In the present example, the control section 22 which extends in the apparatus depth direction on the left end in the apparatus width direction may be configured to extends in the apparatus width direction on the rear side of the movement area of the carriage 34 in the apparatus depth direction. Specifically, as shown in FIGS. 18 and 19, the control section 106 as a "circuit substrate" that extends in the apparatus width direction may be disposed on the rear side of the frame member 104 that extends in the apparatus width direction on the rear side of the movement area of the carriage 34 in the apparatus depth direction. In this configuration, the ink tank unit 26, that is, the ink tank 28 is disposed on the apparatus front side in the apparatus depth direction, and the control section 106 is disposed on the apparatus rear side.

To summarize the above description, the printer 10 includes a recording head 46 having a nozzle that is configured to eject ink; an ink tank 28 that is configured to receive ink ejected from the nozzle, and is disposed at a separate position from the recording head 46; and a power supply section 20 that supplies electric power at least required for ink ejection from the recording head 46, wherein at least part of the ink tank 28 overlaps at least part of the power supply section 20 in an apparatus depth direction.

According to the above configuration, at least part of the ink tank 28 overlaps at least part of the power supply section 20 in an apparatus depth direction. Accordingly, the entire occupation region of the ink tank 28 and the entire occupation region of the power supply section 20 do not superpose each other in the apparatus depth direction, thereby reducing the dimension in the apparatus depth direction.

The printer 10 includes a recording head 46 having a nozzle that is configured to eject ink; an ink tank 28 that is configured to receive ink ejected from the nozzle, and is disposed at a separate position from the recording head 46; and a power supply section 20 that supplies electric power at least required for ink ejection from the recording head 46, wherein at least part of the ink tank 28 overlaps at least part of the power supply section 20 in an apparatus height direction. According to this configuration, the entire occupation region of the ink tank 28 and the entire occupation region of the power supply section 20 do not superpose each other in the apparatus height direction, thereby reducing the dimension in the apparatus depth direction.

The ink tank 28 includes the ink introduction port 28*d* that allows for ink introduction. According to this configuration, the ink tank 28 can be replenished with ink in a simple operation.

The ink introduction port 28*d* is located on the front side relative to the power supply section 20 in the apparatus depth direction.

The printer 10 includes the operation panel 16 that performs various operations on the apparatus front side, wherein the ink introduction port 28*d* overlaps at least part of the operation panel 16, that is, the hinge section 16*a* in the apparatus depth direction. According to this configuration, since the ink introduction port is located at a position close to the apparatus front surface, ink introduction from the ink introduction port can be performed in a simple operation.

The printer 10 includes the buffer tank 66 that is connected to the ink tank 28 and stores ink discharged from the ink tank 28, wherein at least part of the ink tank 28 overlaps at least part of the buffer tank 66 in the apparatus width direction which is a direction perpendicular to the apparatus depth direction. According to this configuration, the entire occupation region of the ink tank 28 and the entire occupation region of the buffer tank 66 do not superpose each other in the apparatus width direction, thereby reducing the dimension in the apparatus width direction.

The printer 10 includes the buffer tank 66 that is connected to the ink tank 28 and stores ink discharged from the ink tank 28, wherein at least part of the ink tank 28 overlaps at least part of the buffer tank 66 in the apparatus depth direction. According to this configuration, the entire occupation region of the ink tank 28 and the entire occupation region of the buffer tank 66 do not superpose each other in the apparatus depth direction, thereby reducing the dimension in the apparatus depth direction.

The printer 10 includes the waste liquid tank 68 that stores waste ink ejected from the recording head 46, wherein at least part of the ink tank 28 overlaps at least part of the waste liquid tank 68 in the apparatus width direction which is a direction perpendicular to the apparatus depth direction. According to this configuration, the entire occupation region of the ink tank 28 and the entire occupation region of the waste liquid tank 68 do not superpose each other in the apparatus width direction, thereby reducing the dimension in the apparatus width direction.

The printer 10 includes a control section 22 that constitutes a control means that performs control of the apparatus, wherein the ink tank 28 is provided on a first end of the apparatus and the control section 22 is provided on a second side of the apparatus in the apparatus width direction which is a direction perpendicular to the apparatus depth direction. According to this configuration, ink does not almost attach to the control section 22 even if it leaks out from the ink tank 28, thereby maintaining the performance of the control section 22.

The printer 10 includes a control section 106 that constitutes a control means that performs control of the apparatus, wherein the ink tank 28 is provided on an apparatus front side, and the control section 106 is provided on an apparatus rear side. According to this configuration, ink does not almost attach to the control section 106 even if it leaks out from the ink tank 28, thereby maintaining the performance of the control section 106.

The ink tank 28 is housed in the housing 30 that constitutes the outermost part of the apparatus. According to this configuration, infiltration of dust or the like into the ink tank 28 can be prevented.

Further, in the present embodiment, the ink tank 28, the buffer tank 66, the waste liquid tank 68 and the control sections 22 and 106 according to the present invention are applied to an ink jet printer which is an example of a liquid ejecting apparatus. However, they can also be applied to other liquid ejecting apparatuses in general. The liquid ejecting apparatus described herein is not limited to recording apparatuses such as printers, copy machines and facsimile machines that use an ink jet recording head and perform recording by ejecting ink from the recording head onto a recording medium, and includes apparatuses that eject liquid substituting for ink according to the application from a liquid ejecting head which corresponds to the ink jet recording head onto an ejection target medium which corresponds to the recording medium so as to attach the liquid onto the ejection target medium.

In addition to the aforementioned recording heads, the liquid ejecting head includes color material ejection heads used for manufacturing color filters for liquid crystal displays and the like, electrode material (electrically conductive paste) ejection heads used for manufacturing electrodes for organic EL displays, field emission displays (FEDs) and the like, bioorganic ejection heads used for manufacturing biochips, and sample ejection heads which are micropipettes.

It should be noted that the present invention is not limited to the above embodiments. Regardless to say, various modifications are contemplated within the scope of the invention as defined in the appended claims, and these should be included in the scope of the present invention.

The entire disclosure of Japanese Patent Application No. 2016-215981, filed Nov. 4, 2016, is expressly incorporated by reference herein.

What is claimed is:

1. A liquid ejecting apparatus comprising:

a liquid ejecting section having a nozzle that is configured to eject liquid, the liquid ejecting section being movable with a carriage that is configured to scan in an apparatus width direction;

a liquid container that is configured to accommodate the liquid ejected from the nozzle, and is disposed at a separate position from the liquid ejecting section and the carriage, wherein the liquid is delivered to the liquid ejecting section from the liquid container;

an operation panel disposed on a front side in an apparatus depth direction; and a power supply section that supplies electric power at least required for liquid ejection from the liquid ejecting section and that is disposed on a rear side of the operation panel, wherein the power supply section is connected to an inlet disposed on a rear side of the liquid container in the apparatus depth direction, wherein at least part of the liquid container overlaps at least part of the power supply section in the apparatus depth direction when viewed in the apparatus width direction, wherein the apparatus depth direction is transverse to the apparatus width direction and to an apparatus height direction.

2. The liquid ejecting apparatus according to claim 1, further comprising:

wherein at least part of the liquid container overlaps at least part of the power supply section in an apparatus height direction when viewed in the apparatus depth direction.

3. The liquid ejecting apparatus according to claim 1, wherein the liquid container has an introduction port that allows for liquid introduction.

4. The liquid ejecting apparatus according to claim 3, wherein the introduction port is located on a front side of the liquid ejecting apparatus relative to the power supply section in the apparatus depth direction.

5. The liquid ejecting apparatus according to claim 3, further comprising an operation panel that performs various operations on an apparatus front side, wherein the introduction port overlaps at least part of the operation panel in the apparatus depth direction when viewed in the apparatus width direction.

6. The liquid ejecting apparatus according to claim 1, further comprising a buffer container that is connected to the liquid container so as to store liquid discharged from the liquid container, wherein at least part of the liquid container overlaps at least part of the buffer container in the apparatus width direction which is a direction perpendicular to the apparatus depth direction when viewed in the apparatus depth direction.

7. The liquid ejecting apparatus according to claim 1, further comprising a buffer container that is connected to the liquid container so as to store liquid discharged from the liquid container, wherein at least part of the liquid container overlaps at least part of the buffer container in the apparatus depth direction when viewed in the apparatus width direction.

8. The liquid ejecting apparatus according to claim 1, further comprising a waste liquid container that stores waste liquid ejected from the liquid ejecting section, wherein at least part of the liquid container overlaps at least part of the waste liquid container in the apparatus width direction which is a direction perpendicular to the apparatus depth direction when viewed in the apparatus depth direction.

9. The liquid ejecting apparatus according to claim 1, further comprising a circuit substrate that constitutes a control means that performs control of the apparatus, wherein the liquid container is provided on a first side of the apparatus and the circuit substrate is provided on a second side of the apparatus in the apparatus width direction which is a direction perpendicular to the apparatus depth direction.

10. The liquid ejecting apparatus according to claim 1, further comprising a circuit substrate that constitutes a control means that performs control of the apparatus, wherein the liquid container is provided on an apparatus front side, and the circuit substrate is provided on an apparatus rear side.

11. The liquid ejecting apparatus according to claim 1, wherein the liquid container is housed in a housing that constitutes an outermost part of the apparatus.

* * * * *